US008646905B2

(12) United States Patent
Iijima et al.

(10) Patent No.: US 8,646,905 B2
(45) Date of Patent: Feb. 11, 2014

(54) CONVEYOR DEVICE AND INKJET RECORDING APPARATUS

(75) Inventors: Shota Iijima, Kasugai (JP); Iwane Sano, Obu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 202 days.

(21) Appl. No.: 13/355,015

(22) Filed: Jan. 20, 2012

(65) Prior Publication Data

US 2012/0188320 A1 Jul. 26, 2012

(30) Foreign Application Priority Data

Jan. 21, 2011 (JP) ..... 2011-011464

(51) Int. Cl.
*B41J 2/01* (2006.01)

(52) U.S. Cl.
USPC ..... 347/104

(58) Field of Classification Search
None
See application file for complete search history.

(56) References Cited

U.S. PATENT DOCUMENTS

2006/0170750 A1 8/2006 Takeshita et al.

FOREIGN PATENT DOCUMENTS

| | | |
|---|---|---|
| JP | 2003-211757 A | 7/2003 |
| JP | 2006-198875 A | 8/2006 |
| JP | 2006-199431 A | 8/2006 |

*Primary Examiner* — Laura Martin
*Assistant Examiner* — Tracey McMillion
(74) *Attorney, Agent, or Firm* — Baker Botts L.L.P.

(57) ABSTRACT

A conveyor device includes a drive roller that conveys a tray or a sheet through a conveying path, a rotating shaft that rotates between a third position and a second position via a first position, a spur roller that moves between a fourth position and a fifth position, a first contacting portion that is disposed in the conveying path when the rotating shaft is in the first position and that contacts one surface of the tray passing through the conveying path when the rotating shaft is in the second position, and is separated from the conveying path when the rotating shaft is in the third position, a second contacting portion that moves the spur roller, and a rotating unit configured to rotate the rotating shaft from the third position to the first position.

12 Claims, 13 Drawing Sheets

CONVEYOR DEVICE AND INKJET RECORDING APPARATUS

CROSS-REFERENCE TO RELATED APPLICATION

This application claims priority from Japanese Patent Application No. 2011-011464, filed on Jan. 21, 2011, which is incorporated herein by reference.

BACKGROUND OF THE INVENTION

1. Field of the Invention

The invention relates generally to a conveyor device of an image forming apparatus configured to convey a sheet or a tray on which a recording medium is placed, and an inkjet recording apparatus configured to eject ink droplets onto the sheet or the recording medium which is conveyed by the conveyor device.

2. Description of Related Art

A known inkjet recording apparatus is configured to record an image onto a sheet or a tray on which a recording medium, e.g., a CD or a DVD, and convey the sheet or the tray by a conveyor device.

The known inkjet recording apparatus includes a first drive roller and a second drive roller that are disposed in a conveying path through which the sheet or the tray is conveyed. A spur and a following roller are disposed to face the first drive roller and the second drive roller, respectively, and the conveying path passes therebetween. The spur is configured to be changeable between a first state, in which the spur is in contact with the first drive roller, and a second state, in which the spur is separated from the conveying path. In the first state, the spur is urged toward the first drive roller. The following roller is separated from the second drive roller at a distance that is less than a thickness of the tray. When the tray is inserted between the second drive roller and the following roller, the following roller is separated further from the second drive roller. In coordination with the movement of the following roller, the spur is separated from the conveying path.

SUMMARY OF THE INVENTION

In the known inkjet recording apparatus, the tray contacts an abutment portion of the following roller disposed in the conveying path and changes the state of the abutment portion, and the spur is separated from the first drive roller in coordination with the state change of the abutment portion. With this configuration, a sheet may contact the abutment portion disposed in the conveying path. In order to solve this problem, the spur may be separated from the first drive roller by using a drive motor or an operating portion that may be operated by the user. Nevertheless, the spur may be separated from the first drive roller against an urging force of an urging member configured to urge the spur toward the first drive roller. Therefore, the drive motor may require higher torque or the apparatus' utility may be reduced.

Thus, a need has arisen for a mechanism for an image forming apparatus, which overcomes these and other shortcomings of the related art. A technical advantage of the present invention is that the mechanism may allow an abutment portion to be sufficiently separated from a drive roller, such that the abutment portion does not contact a sheet and that less force is required to change a state of the abutment portion.

According to one embodiment of the invention, a conveyor device comprising: a drive roller configured to selectively convey one of a tray and a sheet through a conveying path; a rotating shaft extending in a direction parallel to an axial direction of the drive roller and configured to selectively rotate between a third position and a second position via a first position; a spur roller disposed opposite from the drive roller across the conveying path and configured to move between a fourth position, in which the spur roller contacts the drive roller, and an fifth position, in which the spur roller separates from the drive roller at a distance greater than a thickness of the tray; a first contacting portion protruding from the rotating shaft in a radial direction of the rotating shaft, wherein the first contacting portion is disposed in the conveying path when the rotating shaft is in the first position, the first contacting portion is configured to contact one surface of the tray passing through the conveying path when the rotating shaft is in the second position, and the first contacting portion is separated from the conveying path when the rotating shaft is in the third position; a second contacting portion protruding from the rotating shaft in the radial direction and configured to move the spur roller, such that, when the rotating shaft is in the first position, the spur roller is in the fourth position, and when the rotating shaft is in the second position, the spur roller is in the fifth position; and a rotating unit configured to rotate the rotating shaft from the third position to the first position.

According to another embodiment of the invention, an inkjet recording apparatus, comprising: conveyor device comprising: a drive roller configured to selectively convey one of a tray and a sheet through a conveying path; a rotating shaft extending in a direction parallel to an axial direction of the drive roller and configured to selectively rotate between a third position and a second position via a first position; a spur roller disposed opposite from the drive roller across the conveying path and configured to move between a fourth position, in which the spur roller contacts the drive roller, and an fifth position, in which the spur roller separates from the drive roller at a distance greater than a thickness of the tray; a first contacting portion protruding from the rotating shaft in a radial direction of the rotating shaft, wherein the first contacting portion is disposed in the conveying path when the rotating shaft is in the first position, the first contacting portion is configured to contact one surface of the tray passing through the conveying path when the rotating shaft is in the second position, and the first contacting portion is separated from the conveying path when the rotating shaft is in the third position; a second contacting portion protruding from the rotating shaft in the radial direction and configured to move the spur roller, such that, when the rotating shaft is in the first position, the spur roller is in the fourth position, and when the rotating shaft is in the second position, the spur roller is in the fifth position; and a rotating unit configured to rotate the rotating shaft from the third position to the first position; and a recording portion configured to record an image on the sheet or a recording medium disposed in the tray passing through the conveying path by ejecting ink droplets on the sheet or the recording medium.

According to the invention, because the rotating shaft is located in the third position while the sheet or tray is being conveyed, the first contact portion does not contact the sheet or they tray being conveyed. Further, the rotating unit can rotate the rotating shaft without opposing the urging force of the first urging member and the rotating unit rotates the rotating shaft with less force.

Other objects, features, and advantages will be apparent to persons of ordinary skill in the art from the following detailed description of the invention and the accompanying drawings.

BRIEF DESCRIPTION OF THE DRAWINGS

For a more complete understanding of the present invention, needs satisfied thereby, and the objects, features, and advantages thereof, reference now is made to the following descriptions taken in connection with the accompanying drawings.

DETAILED DESCRIPTION OF EMBODIMENTS OF THE INVENTION

Figure 1:
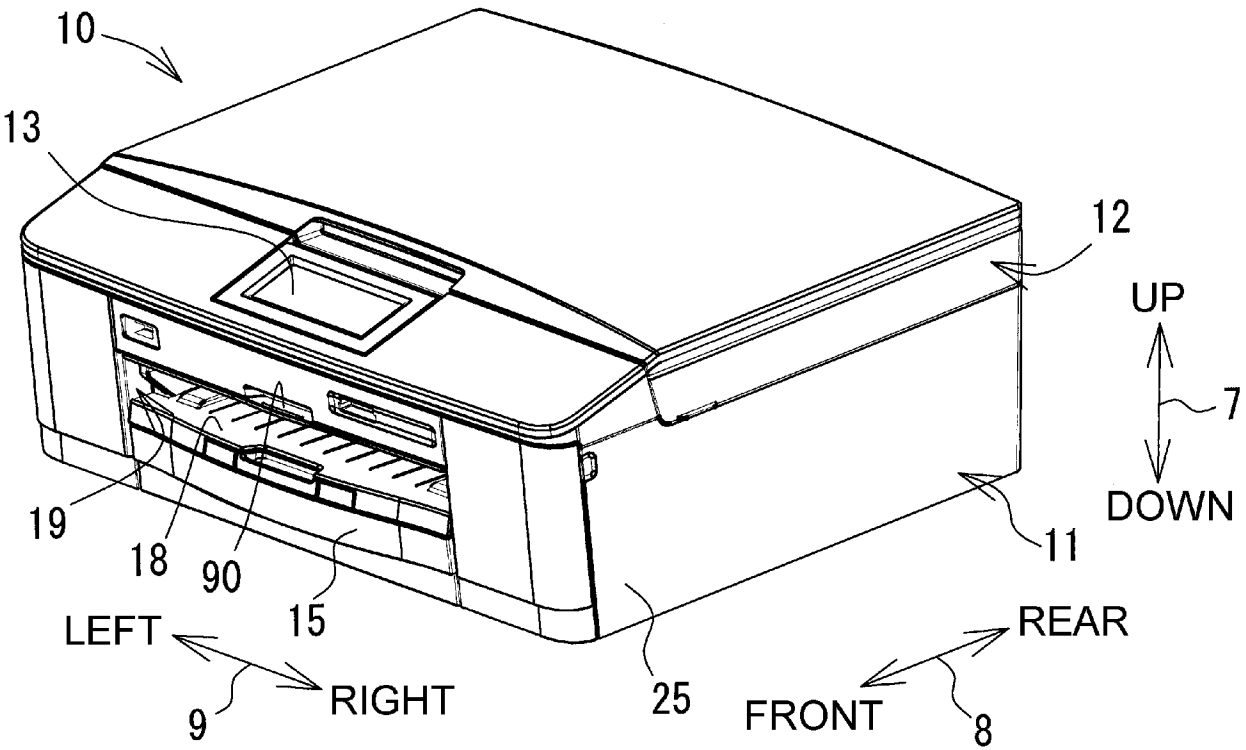
FIG. 1 is a perspective view depicting an image recording apparatus, according to an embodiment of the invention.

Embodiments of the invention now are described in detail with reference to the accompanying drawings, like reference numerals being used for like corresponding parts in the various drawings.

As depicted in FIG. 1, an up-down direction 7 may be defined with reference to an upright orientation in which an inkjet recording apparatus 10 is used. A side of the inkjet recording apparatus 10, in which a display portion 13 is provided, may be defined as the front of the inkjet recording apparatus 10. A front-rear direction 8 may be defined with reference to the front of the inkjet recording apparatus 10. A right-left direction 9 may be defined with respect to the inkjet recording apparatus 10 as viewed from its front.

As depicted in FIG. 1, the inkjet recording apparatus 10 may be a multifunction peripheral device comprising one or more of a printing function, a scanning function, and a copying function. The inkjet recording apparatus 10 may have a substantially rectangular parallelepiped shape and may comprise a printer portion 11 at its upper part and a scanner portion 12 at its lower part.

Figure 2:
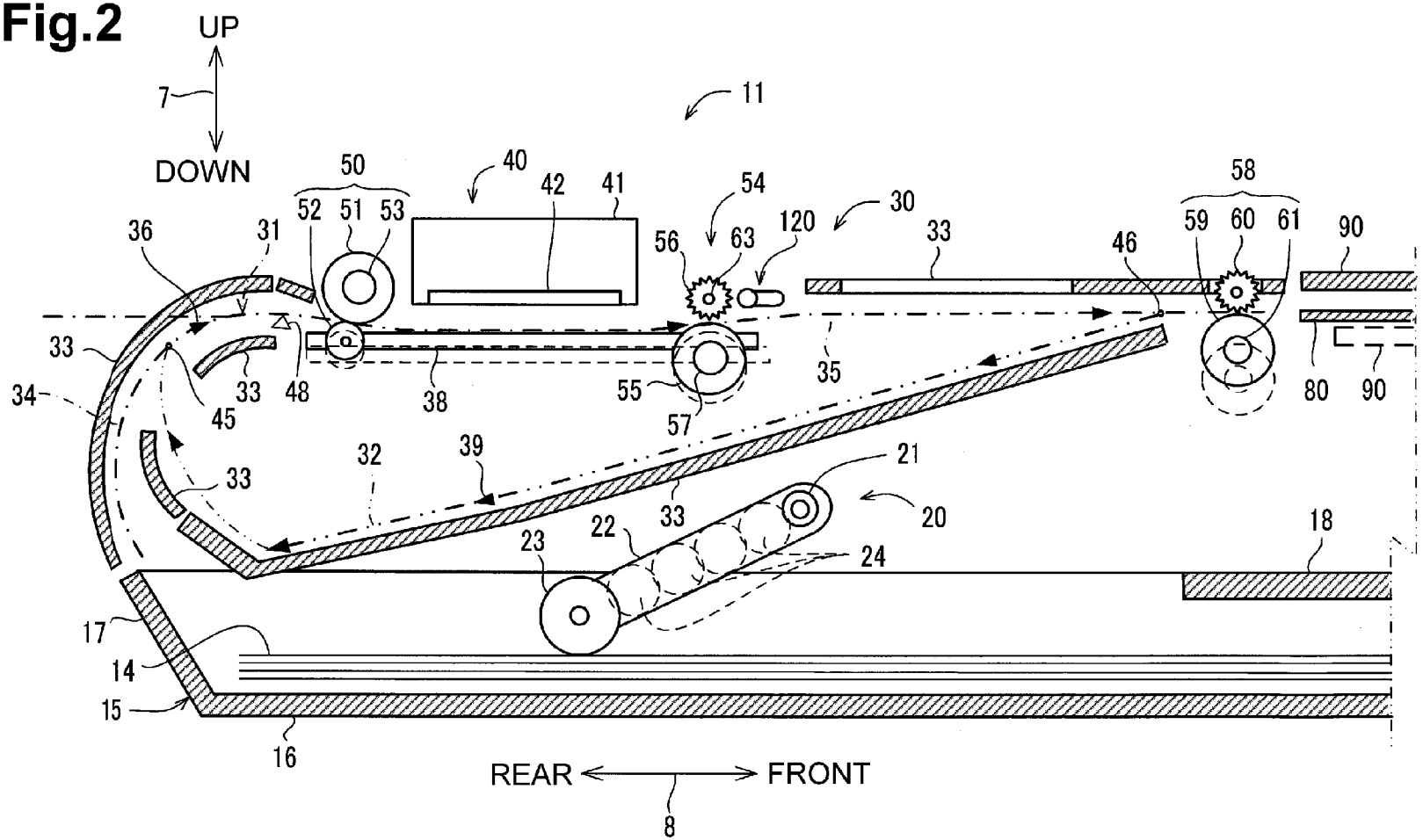
FIG. 2 is a schematic cross-sectional view depicting a printer portion of the image recording apparatus, according to an embodiment of the invention.
Figure 5:
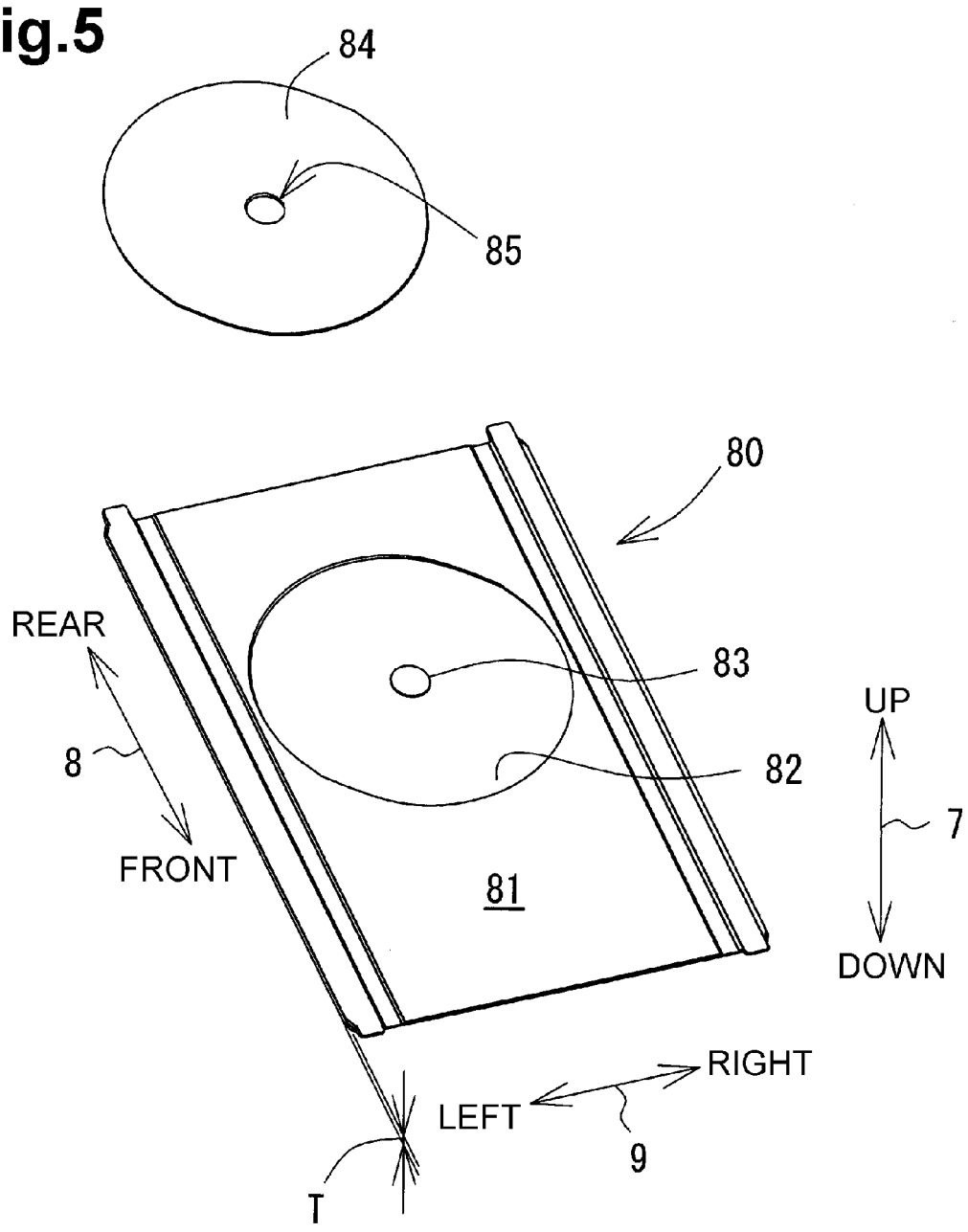
FIG. 5 is a perspective view depicting a tray and a recording medium, according to an embodiment of the invention.

The printer portion 11 may be controlled by a control portion. The control portion may comprise a microcomputer disposed on a substrate. The control portion may control the operation of the printer portion 11 based on information input through an input portion or an external device, e.g., a personal computer, to record an image on a sheet 14, as shown in FIG. 2, or a recording medium 84 placed on a tray 80, as shown in FIG. 5. The sheet 14 may be a recording paper, glossy paper, a postcard, an envelop, or the like. The recording medium 84 may be a CD-ROM, a DVD-ROM, or another rigid or semi-rigid printable surface. The control portion may control the operation of the printer portion 11 to record an image on both sides of a sheet 14.

Sheets 14 may be accommodated in a sheet cassette 15, as depicted in FIG. 1. The sheet cassette 15 may be disposed in a lower portion of the printer portion 11, such that the sheet cassette 15 may be inserted to or removed from the inkjet recording apparatus 10 via an opening 19 formed in the front of the printer portion 11. The sheet cassette 15 may have a substantially flat, rectangular, parallelepiped shape with uncovered top. The sheet cassette 15 may comprise a discharged sheet rest 18 at its upper surface.

As depicted in FIG. 2, the sheets 14 may be received on a lower surface 16 of the sheet cassette 15. The sheet cassette 15 may comprise a rear wall 17 that may extend upward obliquely from a rear end of the lower surface 16. A sheet 14 may be fed from the sheet cassette 15 by a feeding portion 20 and guided by the rear wall 17 to move obliquely upward.

Figure 3:
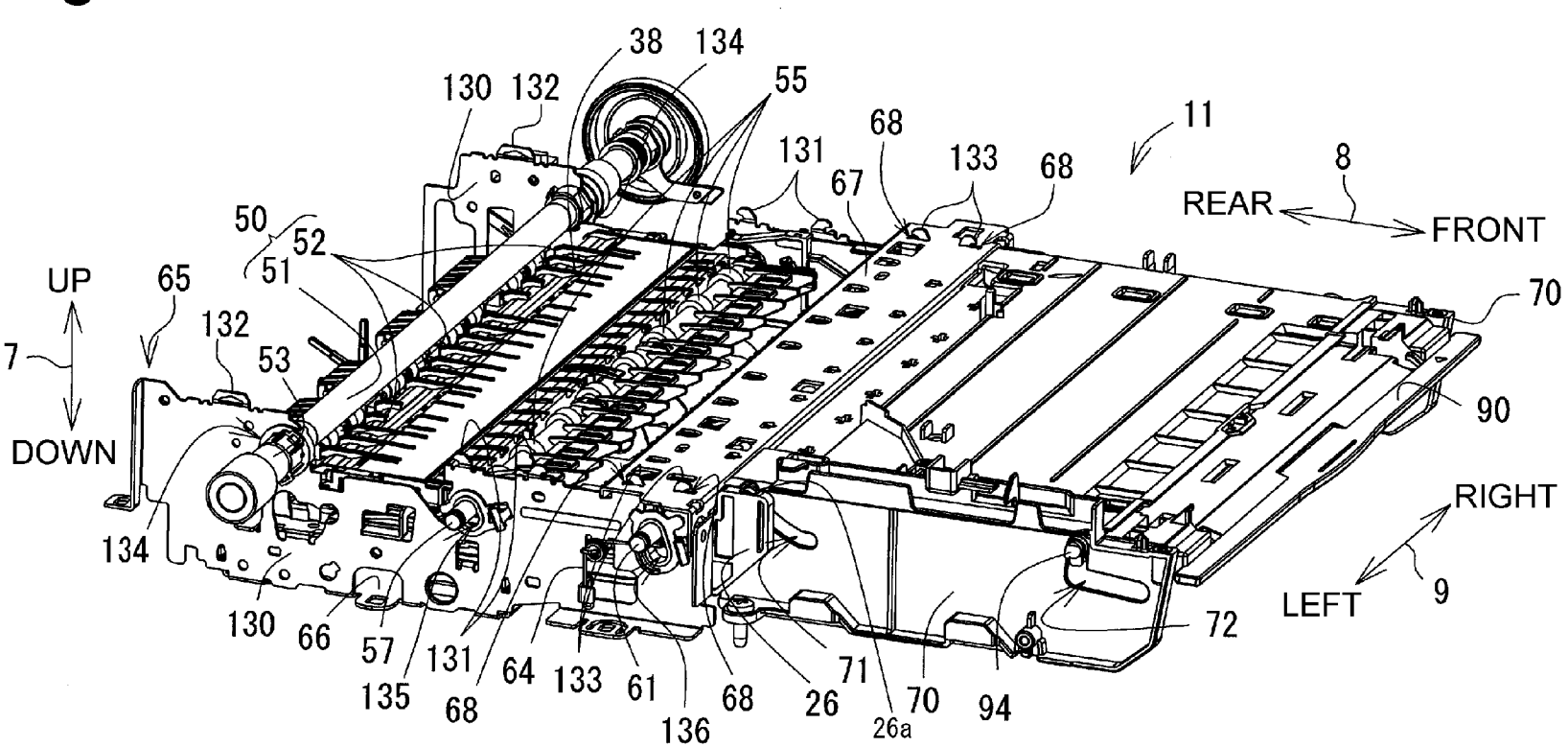
FIG. 3 is a perspective view depicting the printer portion of the image recording apparatus, according to an embodiment of the invention.

As depicted in FIGS. 2 and 3, the printer portion 11 may comprise the feeding portion 20, a conveyor device 30, a recording portion 40, a main frame 65, a pair of right and left side frames 70, a sensing mechanism, and a driving portion. The driving portion may comprise a plurality of drive motors driven and controlled by the control portion, and a power transmission mechanism configured to transmit power of the drive motors to the feeding portion 20, the conveyor device 30, and a carriage 41 of the recording portion 40.

As depicted in FIG. 2, the feeding portion 20 also may comprise a support shaft 21, an arm 22, and a pair of right and left feeding rollers 23. The support shaft 21 may be supported rotatably by the main frame 65. The arm 22 may extend obliquely downward from the support shaft 21. The feeding rollers 23 may be disposed respectively at right and left ends of the arm 22. The support shaft 21 may extend in the right-left direction 9 and may be rotated by a first drive motor. One end of the arm 22 may be supported rotatably by the support shaft 2 and the other end of the arm 22 may support rotatably the feeding rollers 23. The arm 22 may be rotated when the sheet cassette 15 slides in the front-rear direction 8 and may press the feeding rollers 23 against the sheets 14 accommodated in the sheet cassette 15. The feeding rollers 23 may be rotated by the rotation of the support shaft 21 transmitted through a plurality of transmission gears 24. The feeding rollers 23 may feed the sheets 14, one by one, from the sheet cassette 15 toward the rear. The sheet 14 fed rearward may be conveyed by the conveyor device 30.

Figure 10A:
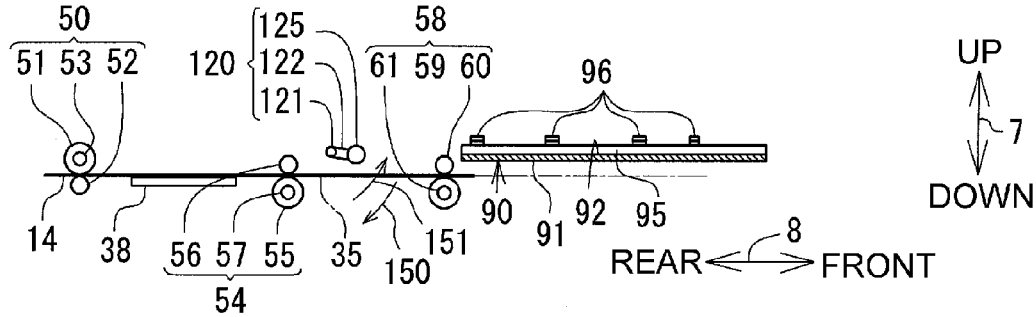
FIG. 10A is a schematic diagram depicting the conveyance of a sheet, according to an embodiment of the invention.
Figure 10B:
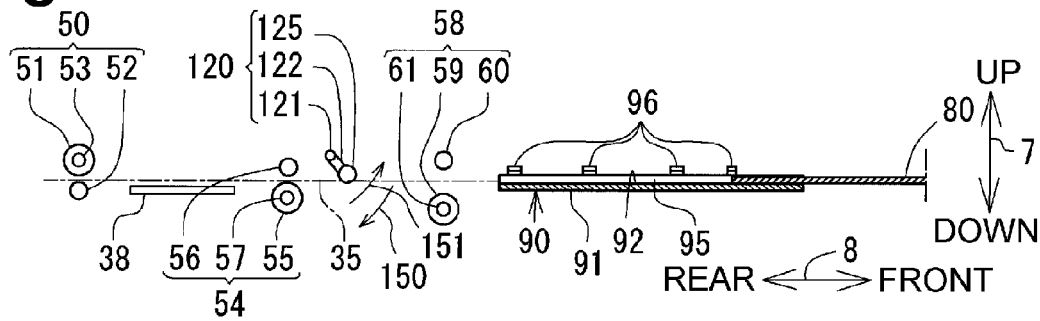
FIG. 10B is another schematic diagram depicting the conveyance of the sheet in FIG. 10A.
Figure 10C:
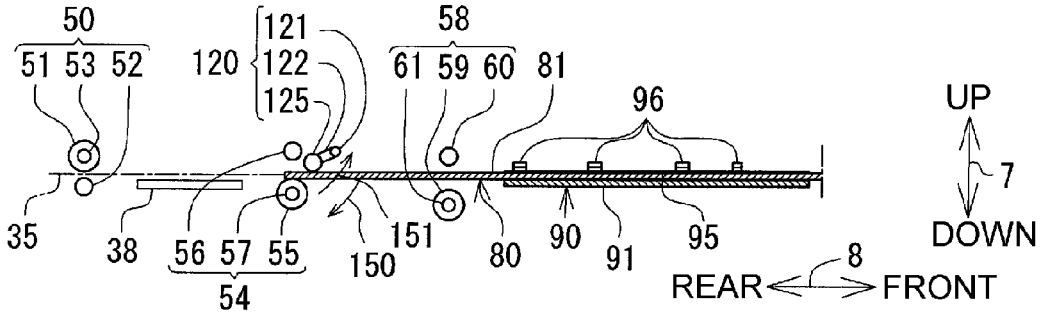
FIG. 10C is still another schematic diagram depicting the conveyance of the sheet in FIG. 10A.
Figure 10D:
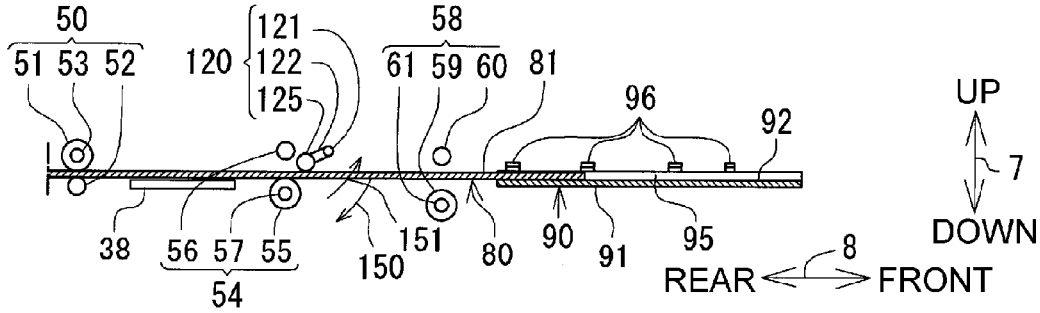
FIG. 10D is yet another schematic diagram depicting the conveyance of the sheet in FIG. 10A.

As depicted in FIG. 2, the conveyor device 30 also may comprise a first conveyor roller portion 50, a second conveyor roller portion 54, a third conveyor roller portion 58, a first conveying path 31 and a second conveying path 32. The first conveyor roller portion 50, the second conveyor roller portion 54, and the third conveyor roller portion 58 may be configured to pinch a sheet 14 between rollers and convey the sheet 14. The sheet 14 may pass through the first and second conveying paths 31 and 32. The first and second conveying paths 31 and 32 may be defined by a plurality of guide members 33 and a platen 38 disposed above the sheet cassette 15. The first conveyor roller portion 50 and a second drive roller 55, e.g., drive roller, of the second conveyor roller portion 54 may convey the tray 80, as depicted in FIG. 10D.

As depicted in FIG. 2, the first conveying path 31 also may comprise a curved section 34 and a straight section 35. In the curved section 34, the sheet 14 may be conveyed in a curved shape in a first conveying direction 36. The straight section 35, e.g., a conveying path, may extend from a downstream end of the curved section 34 toward the front in the first conveying direction 36 and passing above the platen 38. The tray 80 may be conveyed through the straight section 35 of the first conveying path 31.

The second conveying path 32 may extend from a second junction 46 to a first junction 45 and passing between the platen 38 and the sheet cassette 15. The second conveying path 32 may join the first conveying path 38 at the first junction 45 and may branch off from the first conveying path 38 at the second junction 46. The first junction 45 may be disposed upstream from the platen 38 in the first conveying direction 36. The second junction 46 may be disposed downstream from the platen 38 in the first conveying direction 36.

The first conveyor roller portion 50 may be disposed between the first junction 45 and the platen 38 in the first conveying direction 36. The second conveyor roller portion 54 may be disposed between the platen 38 and the second junction 46 in the first conveying direction 36. The third conveyor roller portion 58 may be disposed downstream from the second junction 46 in the first conveying direction 36 and above the discharged sheet rest 18 to discharge the sheet 14 onto the discharged sheet rest 18.

The sensing mechanism may comprise a sensor 48 and an encoder. The sensor 48 may be disposed upstream from the first conveyor roller portion 50 in the first conveying direction 36. The sensor 48 may comprise a photointerrupter comprising a light-emitting diode and a photodiode, and a sensing element configured to selectively protrude into and retract from the first conveying path 31. Light emitted from the light-emitting diode to the photodiode may be blocked or may reach the photodiode based on the position of the sensing element, which may change based on the conveyance of the sheet 14 and an output from the sensor 48. The output from the sensor 48 may change based on whether the sheet 14 is passing through the location of the sensing element.

The encoder may comprise a photointerrupter and a disk attached to a first rotating shaft 53 of the first conveyor roller portion 50. The disk of the encoder may comprise transparent portions, through which light may pass, and nontransparent portions, through which light may not pass. By rotation of the disk, the transparent portions and the nontransparent portions may alternately pass an optical path of the photointerrupter and the output of the encoder may be changed. That is, the number of output changes in the encoder may be changed in accordance with an amount of rotation of the first drive roller 51. Accordingly, the number of output changes in the encoder may correspond to a travel amount of the sheet 14 and a travel amount of the tray 80. The control portion may comprise a counter that may count changes in the output from the encoder. The control portion may detect the travel amount of the sheet 14 or the tray 80 based on the number of counts by the counter. The control portion may be configured to detect the leading and trailing edges of the sheet 14 or the tray 80 in the conveying direction, based on the number of output changes in the encoder after the sheet 14 passes through the sensor 48.

As depicted in FIG. 2, the recording portion 40 may comprise the carriage 41 disposed above the platen 38, and a recording head 42 mounted on the carriage 40. The carriage 41 may be supported by a first guide rail 140 and a second guide rail and may configured to move in the right-left direction 9. The carriage 41 may be moved in the right-left direction 9 by a third drive motor of the driving portion and the power transmission mechanism. The recording head 42 may be configured to eject ink droplets toward the sheet 14 passing over the platen 38 or the recording medium 84 placed on the tray 80.

The sheet 14 fed by the feeding portion 20 from the sheet cassette 15 may be conveyed in the first conveying direction 36 by the first and second conveyor roller portions 50 and 51. The recording portion 40 may record an image on the sheet 14 supported on the platen 38. For single-sided printing, the sheet 14 having the image on its one side may be discharged onto the discharged sheet rest 18 by the third conveyor roller portion 58. For double-sided printing, the sheet 14 having the image on its one side may be conveyed in the first conveying direction 36 by the rotation of the third conveyor roller portion 58 until an upstream edge, e.g., a trailing edge, of the sheet 14 in the first conveying direction 36 passes the second junction 46. The sheet 14 then may be conveyed by the rotation of the third conveyor roller portion 58 in a direction opposite from the first conveying direction 36 to enter the second conveying path 32 from the second junction 46. The sheet 14 may be conveyed in the second conveying path 32 in the second conveying direction 39 by the third conveyor roller portion 58 and may enter the first conveying path 31 at the first junction 45. Thus, the sheet 14 may be turned upside down, such that the recorded side of the sheet 14 may face down, e.g., may face away from the recording head 42. The sheet 14 then may be conveyed in the first conveying path 31 in the first conveying direction 36. The recording portion 30 may record another image on the other side of the sheet 14 supported on the platen 38. The sheet 14 may be discharged onto the discharged sheet rest 18 by the third conveyor roller portion 58.

As depicted in FIG. 3, the main frame 65 may comprise a lower plate 66, right and left side plates 130, an upper plate 67, the first guide rail 140, and the second guide rail. The lower plate 66 and the side plates 130 may be integrally formed by a metal plate such that right and left end portions of the lower plate 66 may be upwardly bent.

A pair of front and rear first insertion pieces 131 for fixing the first guide rail 140, a second insertion piece 132 for fixing the second guide rail, and a pair of front and rear third insertion pieces 133 for fixing the upper plate 67 may protrude from the upper edge of each of the side plates 130. The pair of third insertion pieces 133 may be disposed at the forward part of each of the side plates 130. The pair of first insertion pieces 131 may be disposed at the middle part of each of the side plates 130. The second insertion piece 132 may be disposed at the rearward part of each of the side plates 130.

Figure 6:
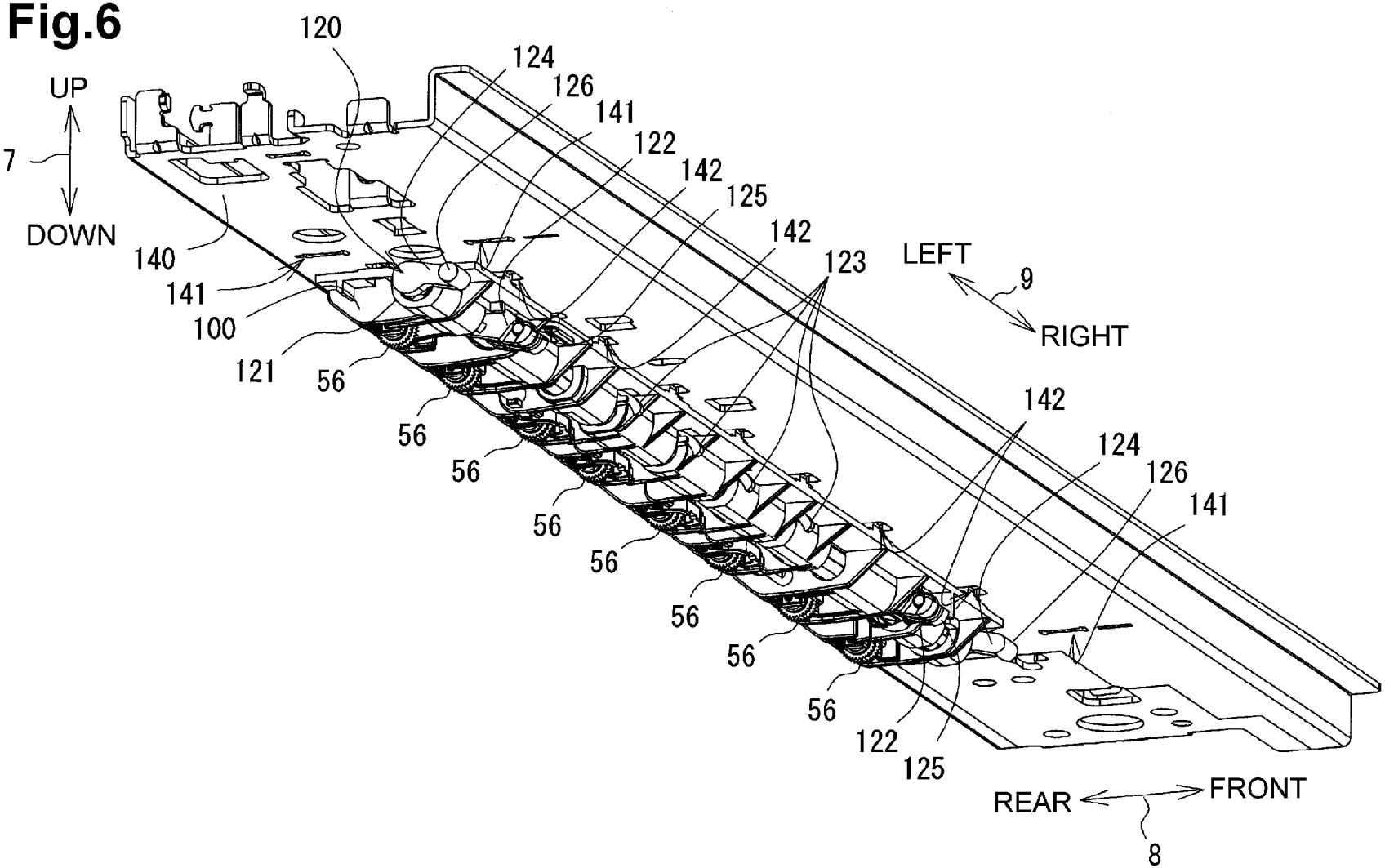
FIG. 6 is a perspective view depicting a portion surrounding a second conveyor roller portion, as viewed from below, according to an embodiment of the invention.
Figure 7:
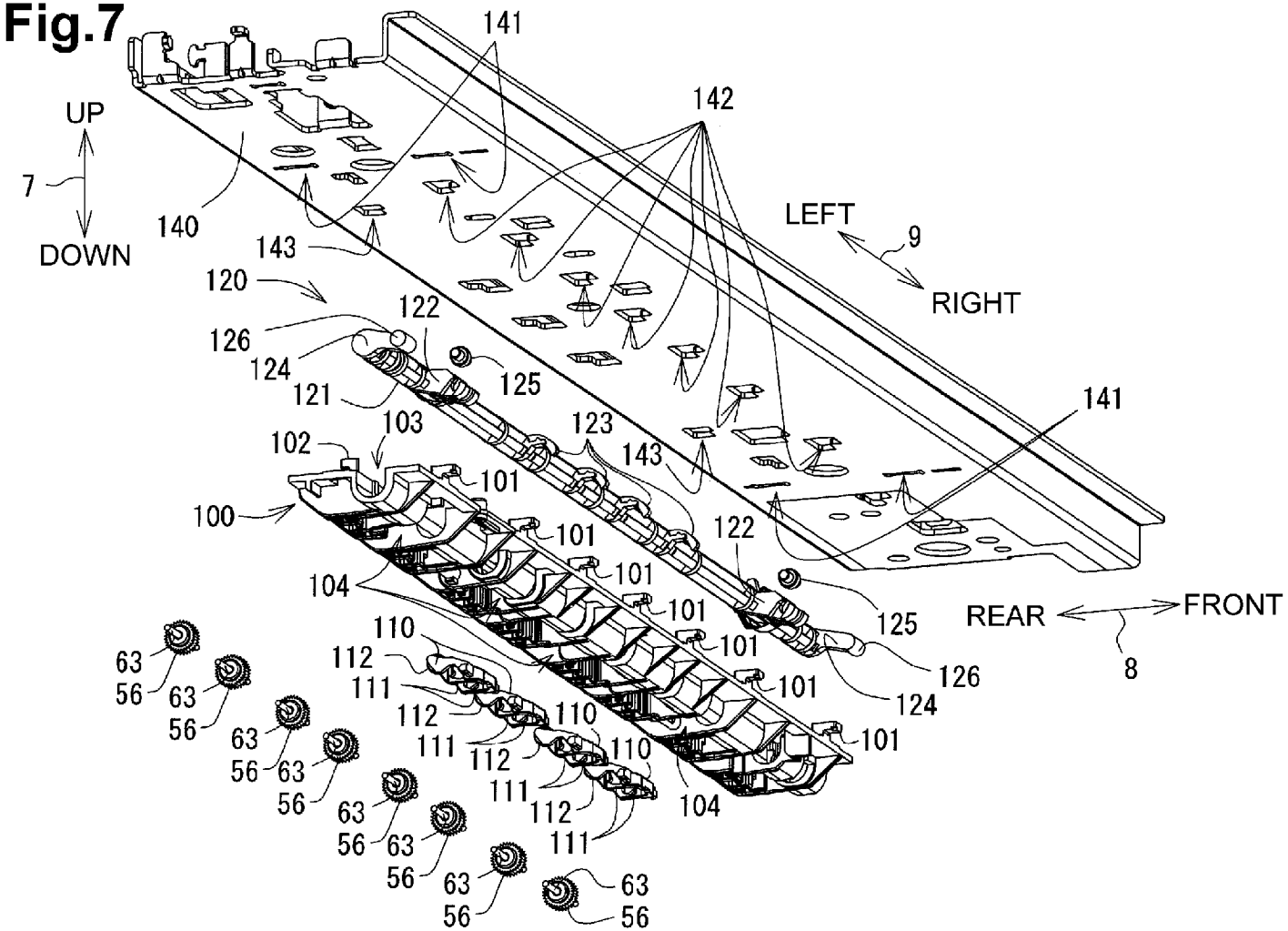
FIG. 7 is an exploded view depicting the portion surrounding the second conveyor roller portion, according to an embodiment of the invention.

As depicted in FIGS. 6 and 7, the first guide rail 140 may have pairs of front and rear first insertion openings 141 in the right and left end portions of the first guide rail 140. The respective first insertion pieces 131 may be inserted into the pairs of front and rear first insertion openings 141. The second guide rail may have second insertion openings, into which the respective second insertion pieces 132 may be inserted. As depicted in FIG. 3, the upper plate 67 may have pairs of front and rear third insertion openings 68, into which the respective third insertion pieces 133 may be inserted. The first insertion pieces 131, the second insertion pieces 132, and the third insertion pieces 133 may be inserted into the first insertion openings 141, the second insertion openings, and the third insertion openings 68, respectively, and then may be bent or twisted to connect the side plates 130, the first guide rail 140, the second guide rail, and the upper plate 67 with each other. Thus, the main frame 65 may be formed by the lower plate 66, the side plates 130, the first guide rail 140, the second guide rail, and the upper plate 67. The carriage 41 may be supported on the first guide rail 140 and the second guide rail that are disposed side by side in the front-rear direction 8. The carriage 41 may be supported by the first guide rail 140 and the second guide rail and may move in the right-left direction 9 in which the first guide rail 140 and the second guide rail extend.

As depicted in FIG. 7, the first guide rail 140 may have a plurality of first engagement openings 142 and a pair of right and left second engagement openings 143. The first engagement openings 142 may be formed in a forward part of the first guide rail 140 in the front-rear direction 8. Hooks 101 provided at an upper holder 100 may be inserted into the respective first engagement openings 142. The second engagement openings 143 may be formed in a rearward part of the first guide rail 140 in the front-rear direction 8. Engaging hooks 102 provided at the upper holder 100 may deform elastically to be inserted into the respective second engagement openings 143. The plurality of first engagement openings 142 may be arranged in a row extending in the right-left direction 9.

As depicted in FIG. 3, each of the side plates 130 may have a circular notch 134 formed therein, a first slot 135 elongated in substantially the up-down direction 7, and a second slot 136 elongated in substantially the up-down direction 7. In each side plate 130, the first rotating shaft 53 of the first conveyor roller portion 50 may be fitted into the notch 134, a second rotating shaft 57 of the second conveyor roller portion 54 may be inserted into the first slot 135, and a third rotating shaft 61 of the third conveyor roller portion 58 may be inserted into the second slot 136.

As depicted in FIG. 2, the first conveyor roller portion 50 may comprise the first drive roller 51 and a first following roller 52. The first drive roller 51 may be disposed on the first rotating shaft 53 that may be rotated by a second drive motor of the driving portion and the power transmission mechanism. The first following roller 52 may be biased toward the first drive roller 51 by a spring. The first drive roller 51 may be disposed above the straight section 35 of the first conveying path 31. The first following roller 52 may be disposed below the straight section 35 of the first conveying path 31. As depicted in FIG. 3, the first rotating shaft 53 may be fitted into the notches 134 formed in the right and left side plates 130 and fixed to the main frame 65. The first following roller 52 may be supported by the platen 38 and may move in the up-down direction 7 together with the platen 38 in coordination with the movement of link plates 26, e.g., movable member, in the front-rear direction 8. The link plates 26 may constitute a portion of the rotating unit.

As depicted in FIG. 2, the second conveyor roller portion 54 may comprise second drive rollers 55 and first spur rollers 56. The second drive rollers 55 may be disposed on a second rotating shaft 57 rotated by the second drive motor of the driving portion and the power transmission mechanism. The second drive rollers 55 may press toward the first spur rollers 56. The second drive rollers 55 may be disposed below the straight section 35 of the first conveying path 31. The first spur rollers 56 may be disposed above the straight section 35 of the first conveying path 31. As depicted in FIG. 3, the second rotating shaft 57 may be inserted into the first slots 135 provided in the right and left side plates 130 of the main frame 65 and may move in the up-down direction 7. The second drive rollers 55, e.g., a drive roller, provided at the second rotating shaft 57 may move between an upper position, e.g., a contacting position, indicated by a solid line in FIG. 2 and a lower position, e.g., a retracted position, indicated by a dashed line in FIG. 2, in accordance with the movement of the second rotating shaft 57 in the up-down direction 7. The second rotating shaft 57 may move in the up-down direction 7, as depicted in FIGS. 10A and 10B, in accordance with the movement of the link plates 26 in the front-rear direction 8 and a position change of a tray guide 90.

Figure 9A:
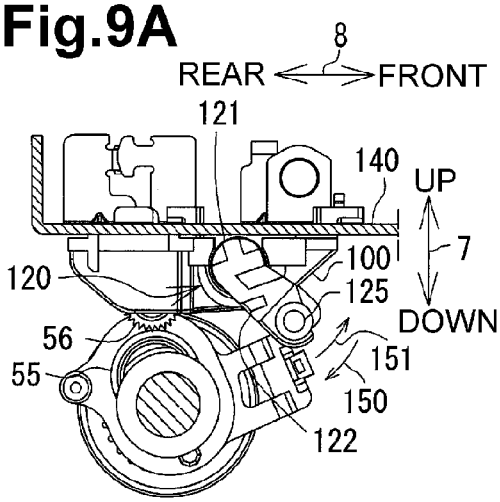
FIG. 9A is a sectional view depicting a moving rotating member, according to an embodiment of the invention.
Figure 9B:
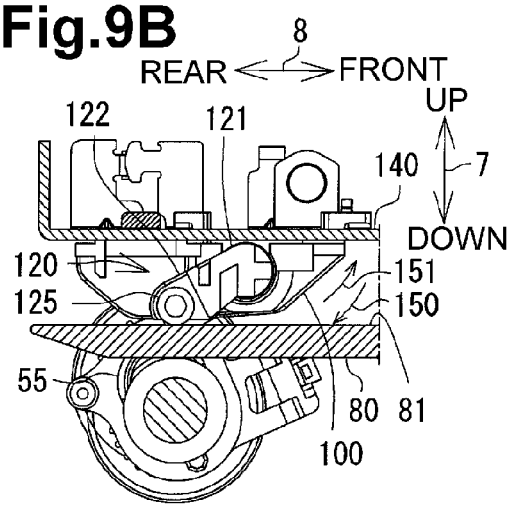
FIG. 9B is another sectional view depicting the moving rotating member of FIG. 9A and a tray, according to an embodiment of the invention.
Figure 9C:
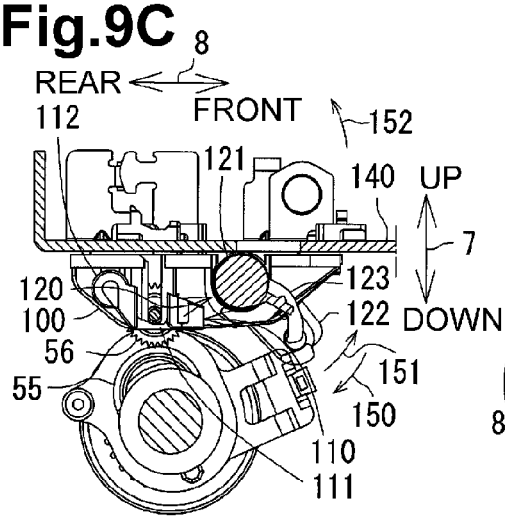
FIG. 9C is still another sectional view depicting the moving rotating member of FIG. 9A, according to an embodiment of the invention.
Figure 9D:
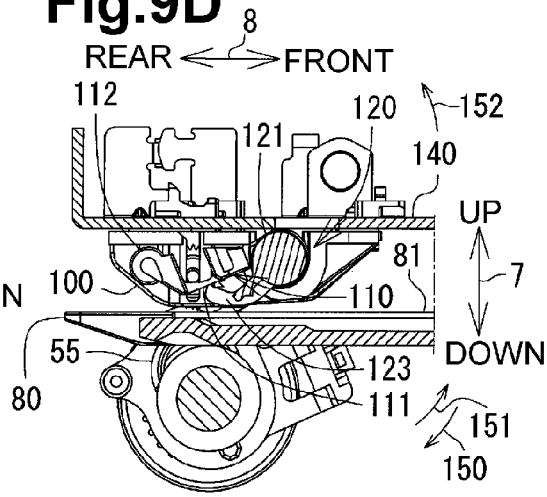
FIG. 9D is yet another sectional view depicting the moving rotating member of FIG. 9A and a tray, according to an embodiment of the invention.
Figure 9E:
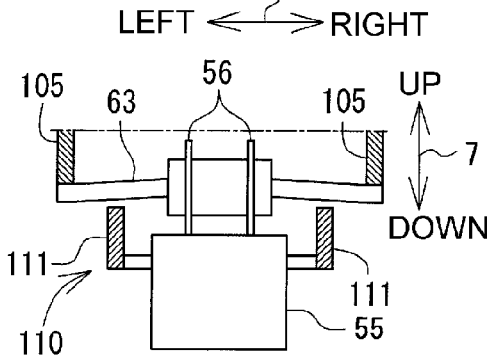
FIG. 9E depicts a deformed elastic shaft, according to an embodiment of the invention.

As depicted in FIGS. 6 and 7, the first spur rollers 56 may be supported to be movable between a lower position, e.g., a fourth position, and an upper position, e.g., a fifth position, by respective elastic shafts 63, e.g., a particular urging member, held by the upper holder 100 and respective lower holders 110. The elastic shafts 63 may be formed of spirally wound wires that may be elastically deformed. When the second drive rollers 55 are located in the upper position, e.g., sheet-conveying position, and when the first spur rollers 56 are located in the lower position, the elastic shafts 63 may be deformed when the first spur rollers 56 are pressed by the second drive rollers 55, as depicted in FIG. 9E. The first spur rollers 56 may be pressed by the respective second drive rollers 55 that are in the upper position by the deformed elastic shafts 63. The first spur rollers 56 may correspond to a spur roller of the invention.

Figure 9F:
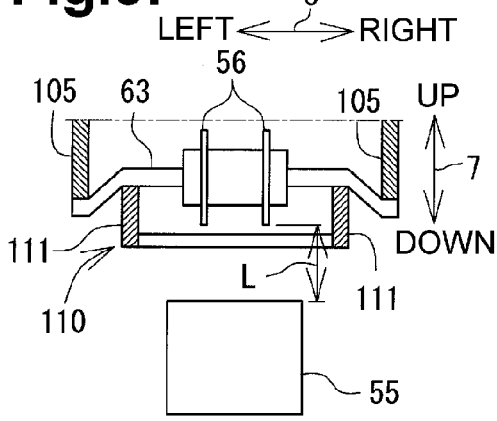
FIG. 9F depicts the deformed elastic shaft of FIG. 9E, according to an embodiment of the invention.

As depicted in FIG. 9F, the upper position of the first spur rollers 56 may be above the lower position of the first spur rollers 56. Therefore, an amount of deformation of the elastic shafts 63 when the first spur rollers 56 are located in the upper position may be greater than the amount of deformation of the elastic shafts 63 when the first spur rollers 56 are located in the lower position.

The first spur rollers 56 may be separated from the second drive rollers 55 disposed in the lower position, e.g., tray-conveying position, by a distance L that is greater than a thickness T of the tray 80, in accordance with the movement of the first spur rollers 56 from the lower position to the upper position. As depicted in FIGS. 10A-10D, the tray 80 may not be pinched between the second drive rollers 55 and the first spur rollers 56. The tray 80 may be pinched and conveyed by the second drive rollers 55 and first contacting portions 122 of a rotating member 120.

As depicted in FIG. 2, the third conveyor roller portion 58 may comprise third drive rollers 59 and second spur rollers 60. The third drive rollers 59 may be disposed on the third rotating shaft 61 rotated by the second drive motors of the driving portion and the power transmission mechanism. The third drive roller 59 may be biased toward the second spur rollers 60 by coil springs 64. The third drive rollers 59 may be disposed below the straight section 35 of the first conveying path 31. The second spur rollers 60 may be disposed above the straight section 35 of the first conveying path 31. As depicted in FIG. 3, the third drive shaft 61 may be inserted into the second slots 136 provided in the right and left side plates 130 of the main frame 65 and may be movable in the up-down direction 7. The third drive rollers 59 provided to the third drive shaft 61 may be movable between an upper position and a lower position in accordance with the movement of the third rotating shaft 61 in the up-down direction 7. The third rotating shaft 61 may be moved in the up-down direction 7 by the link plates 26. The moving distance of the third drive rollers 59 in the up-down direction 7 may be greater than the thickness T of the tray 80. As depicted in FIG. 10C, the tray 80 inserted toward the rear through the opening 19 may pass between each of the third drive rollers 59 and the second spur rollers 60, without contacting the third drive rollers 59 located in the lower position, and the second spur rollers 60.

The platen 38 may support the first following roller 52. The platen 38 may be supported to be movable between an upper position indicated by a solid line in FIG. 2 and a lower position indicated by a dashed line in FIG. 2, in accordance with the movement of the link plates 26 in the front-rear direction 8. The platen 38 may be moved in the up-down direction 7 by the link plates 26. The moving distance of the platen 38 may be substantially the same as the thickness T of the tray 80. Thus, when the platen 38 is located in the lower position, the first drive roller 51 and the first following roller 52 may be separated from each other by a distance that may be substantially the same as the thickness T of the tray 80, such that the tray 80 may be conveyed while pinched by the first conveyor roller portion 50, as depicted in FIG. 10D.

As depicted in FIG. 10A, the sheet 14 may be conveyed while pinched by the first conveyor roller portion 50, the second conveyor roller portion 54, and the third conveyor roller portion 58 when the platen 38, the first following roller 52, the second drive rollers 55, and the third drive rollers 59 are in their upper positions. As depicted in FIG. 10B, when the tray guide 90 is fed frontward, the platen 38, the first following roller 52, the second drive rollers 55 and the third drive rollers 59 may be moved downward by the link plates 26, which may be moved frontward in coordination with the movement of the tray guide 90. The downward movement of the first following roller 52, the second drive rollers 55, and the third drive rollers 59 may expand the straight section 35 of the first conveying path 31 in the up-down direction 7, such that the tray 80 may pass through the straight section 35 of the first conveying path 31, as depicted in FIG. 10D.

As depicted in FIG. 5, the tray 80 may comprise molded resin having a plate-like shape. The tray 80 may comprise a circular recessed portion 82 in which the recording medium 84 may be received. A cylindrical protrusion 83 may protrude from a center portion of a bottom surface of the recessed portion 82. The protrusion 83 may be inserted into a hole 85 formed in a center portion of the recording medium 84. The recording medium 84 may be received in the recessed portion 82 and conveyed in the straight section 35 of the first conveying path 31 by the conveyor device 30 together with the tray 80.

Figure 4A:
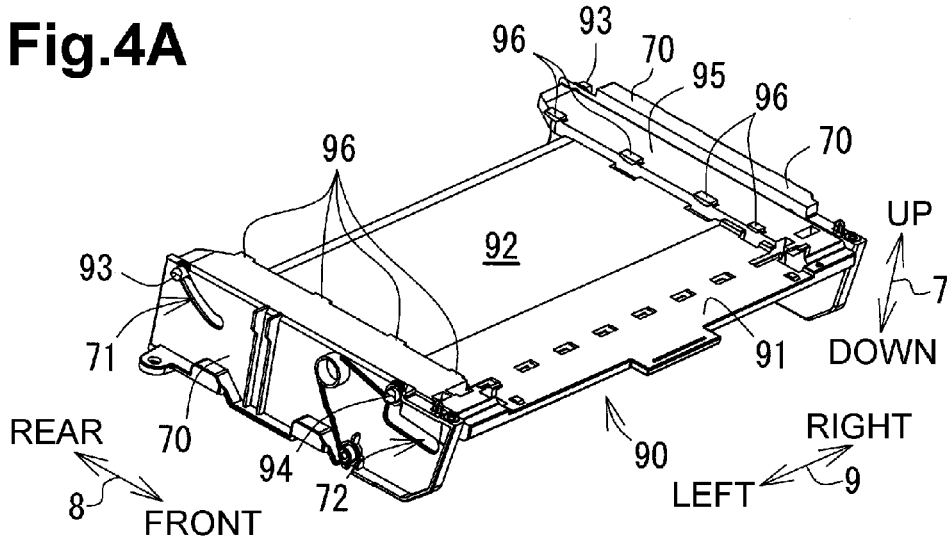
FIG. 4A is a perspective view depicting a tray guide and a side frame, in which the tray guide is in a first position, according to an embodiment of the invention.
Figure 4B:
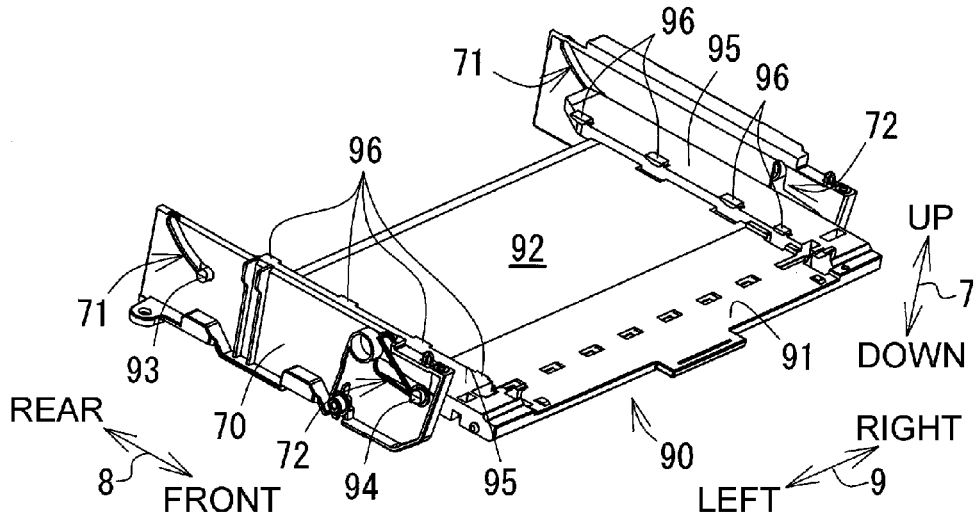
FIG. 4B is a perspective view of the tray guide and the side frame of FIG. 4A, in which the tray guide is in a second position.

As depicted in FIGS. 3-4B, the pair of right and left side frames 70 may comprise molded resin having a rectangular-plate-like shape. The right and left side frames 70 may be disposed opposite to each other in the right-left direction 9. The side frames 70 may be disposed on the front of the right and left side frames 70, respectively, of the main frame 65. Each of the side frames 70 may be formed with a first cam groove 71 and a second cam groove 72. In each of the side frames 70, a first shaft 93 and a second shaft 94 disposed at the tray guide 90 may be inserted into the first cam groove 71 and the second cam groove 72, respectively.

As depicted in FIGS. 4A and 4B, the tray guide 90 may comprise a base plate 91 having a rectangular plate-like shape, a pair of side guides 95, and a plurality of upper guides 96. The pair of right and left side guides 95 may be disposed on a side where an upper surface 92 of the base plate 91 may be disposed. The upper guides 96 may protrude toward a center of the base plate 91 from the upper end portions of each side guide 95 in the right-left direction 8 and may face the upper surface 92 of the base plate 91 in the up-down direction 9. The plurality of upper guides 96 may be arranged in the front-rear direction 8. The tray 80 may be inserted into a space enclosed by the base plate 91, the side guides 95, and the upper guides 96, from the front. The tray guide 90 may be disposed between the pair of right and left side frames 70 and downstream from the third conveyor roller portion 58 in the first conveying direction 36. The tray guide 90 may be disposed in an upper area of the opening 19.

The pair of right and left first shafts 93 may protrude from rear right and left side edges of the base plate 91, respectively. The first shafts 93 may be inserted into the respective first cam grooves 71 provided in the side frames 70. The pair of right and left second shafts 94 may protrude from front right and left side edges of the base late 91, respectively. The second shafts 94 may be inserted into the respective second cam grooves 72 provided in the side frames 70. The tray guide 90 may be supported by the side frames 70 and may be movable between an upper position, e.g., a retracted position, as depicted in FIG. 4A, and a lower position, e.g., a guiding position, as depicted in FIG. 4B. As depicted in FIG. 10A, when the tray guide 90 is located in the upper position, the tray guide 90 may be disposed above the straight section 35 of the first conveying path 31. As depicted in FIG. 10B, when the tray guide 90 is located in the lower position, the tray guide 90 may be disposed below the straight section 35 of the first conveying path 31. The tray guide 90 may be in the upper position, e.g., the retracted position, during the conveyance of the sheet 14 and may not interrupt the discharge of the sheet 14 from the third conveyor roller portion 58 in the upper position. As depicted in FIG. 10D, the tray guide may be in the lower position, e.g., the guiding position, for conveying the tray 80 and may guide the tray 80 between rollers of the third conveyor roller portion 58 in the lower position. The tray guide 90 may move from the upper position to the lower position when the tray guide 90 moves frontward.

As depicted in FIG. 3, each of the link plates 26 may be disposed between the platen 38 and one of the side plates 130 of the main frame 65. Front end portions of the link plates 26 may be disposed outside of rear end portions of the side frames 70, respectively, in the right-left direction 9. Each of the link plates 26 may comprise an engagement portion 26*a* configured to engage the first shaft 93 of the tray guide 90. When the tray guide 90 moves from the upper position, as indicated by a solid line in FIG. 2, to the lower position, as indicated by a dashed line in FIG. 2, the link plates 26 may be pulled by the tray guide 90 via the engagement portions to move from a rearward position to a forward position. When the tray guide 90 moves to the upper position, e.g., retracted position, from the lower position, e.g., guiding position, the link plates 26 may be pushed back toward the rear by the tray guide 90 via the engagement portions to the rearward position, as depicted in FIG. 3.

Figure 12A:
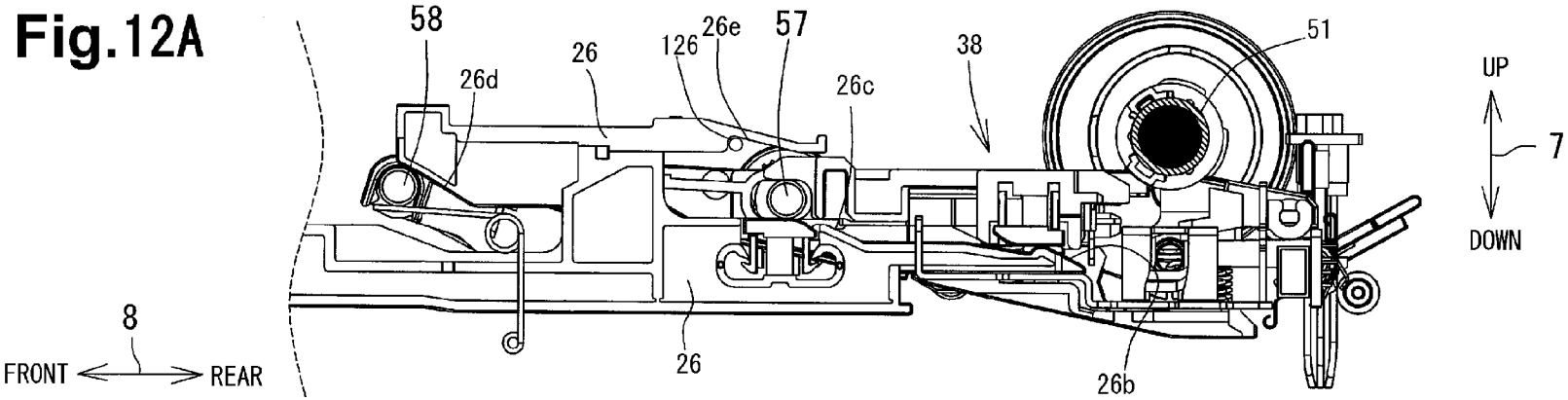
FIG. 12A is a cross-sectional view depicting the movement of a pair of link plates, according to an embodiment of the invention.
Figure 12B:
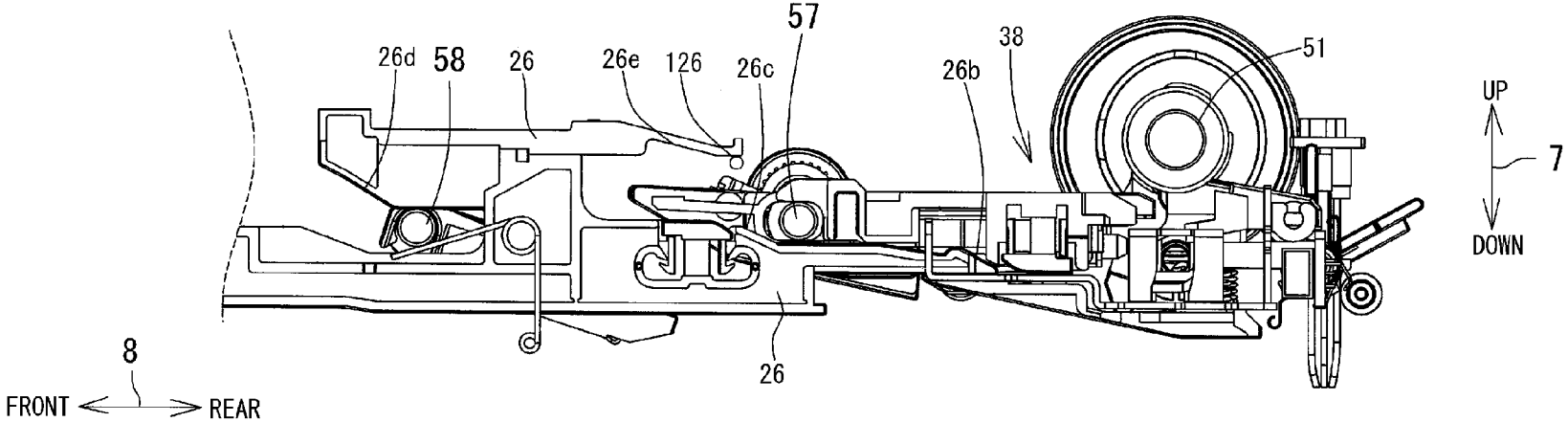
FIG. 12B is another cross-sectional view depicting the movement of the pair of link plates in FIG. 12A, according to an embodiment of the invention.

As depicted in FIGS. 12A and 12B, each of the link plates 29 may comprise inclined surfaces 26*b*, 26*c* and 26*d* configured to contact the platen 38, the second rotating shaft 57, and the third rotating shaft 61, respectively. The inclined surfaces 26*b*, 26*c* and 26*d* may incline toward the rear. As depicted in FIG. 12B, when the link plates 26 moves toward the front, the platen 38, the second rotating shaft 57, and the third rotating shaft 61 may slide over the inclined surfaces 26*b*, 26*c* and 26*d* to their lower positions. As depicted in FIG. 12A, when the link plates 26 move toward the rear, the platen 38, the second rotating shaft 57, and the third rotating shaft 61 may slide over the inclined surfaces 26*b*, 26*c* and 26*d* to their upper positions. When the tray guide 90 moves from the upper position to the lower position, the platen 38, the second drive rollers 55 provided on the second rotating shaft 57 and the third drive rollers 59 provided on the third rotating shaft 61 may move from their upper positions, as depicted by solid lines in FIG. 2, to their lower positions, as depicted by dashed lines in FIG. 2. Thus, the straight section 35 of the first conveying path 31 may expand in the up-down direction 7. The tray 80 may pass through the expanded straight section 35 of the first conveying path 31.

Each of the link plates 26, e.g., a movable member, may have a inclined surface 26*e* configured to contact an protrusion 126 of a third contacting portion 124 of the rotating member 120. In accordance with the movement of the link plates 26 in the front-rear direction 8, the inclined surface 26*e* may press the respective protrusions 126 of the third contacting portions 124 of the rotating member 120, such that the rotating member 120 may rotate.

As depicted in FIGS. 6 and 7, the upper holder 100 and the lower holders 110 may support the first spur rollers 56 and the rotating member 120. As depicted in FIG. 7, the upper holder 100 may comprise the plurality of hooks 101 and engaging hooks 102. The hooks 101 may be received in the respective first engagement openings 142 provided in the first guide rail 140. The engaging hooks 102 may be received in the respective second engagement openings 143 when elastically deformed. The hooks 101 may be formed, such that their tip portions may extend toward the front. The engaging hooks 102 may be formed, such that their tip portions may extend toward the rear. During assembly, the hooks 101 may be inserted into the respective first engagement openings 142, and the upper holder 100 then may be shifted toward the front to hook the tip end portions of the hooks 101 on the upper holder 100. The upper holder 100 then may be pressed against the first guide rail 140, and the engaging hooks 102 may be deformed to be inserted into the respective second engagement openings 143, such that the tip end portions of the engaging hooks 102 hook on the first guide rail 140. Thus, the upper holder 100 may be attached to the first guide rail 140.

The upper holder 100 may have a recessed portion 103 in its upper portion. A fourth rotating shaft 121 of the rotating member 120 may be received in the recessed portion 103. The upper holder 100 may be configured to hold the rotating member 120 by a lower surface of the first guide rail 140 and a wall surface of the recessed portion 103, such that the rotating member 120 may be rotatable in the upper holder 100.

The upper holder 100 may comprise a plurality of hollow portions 104 into which the lower holders 110 may be received, respectively. The upper holder 100 may rotatably support the lower holders 110. As depicted in FIGS. 9E and 9F, the upper holder 100 may comprise bearing portions 105 configured to support both right and left end portions of the elastic shafts 63.

As depicted in FIGS. 9E and 9F, the lower holders 110 may be configured to press the respective elastic shaft 63 to move the spur rollers 56 upward. As depicted in FIG. 7, each lower holder 110 may comprise rotating shafts 112 at its rear end. The rotating shafts 112 may be rotatably supported by the upper holder 100. The lower holders 110 may be pressed from below by the respective second contacting portions 123 of the rotating member 120 and may rotate from a lower position, e.g., a nondeforming position, as depicted in FIG. 9C, to an upper position, e.g., a deforming position, as depicted in FIG. 9D. The lower holders 110 may be provided for the first spur rollers 56, such that the recording medium 84 loaded on the tray 80 may be conveyed under the first spur rollers 56. As depicted in FIG. 7, the four lower holders 110 may be provided to the upper holder 100 may correspond to the four first spur rollers 56 provided at the central portion of the upper holder 100 in the right-left direction 9, as depicted in FIG. 7.

Each lower holder 110 may comprise fourth contacting portions 111 configured to separate from the elastic shaft 63 when the lower holder 110 is in the lower position, as depicted in FIG. 9E, and configured to contact the elastic shaft 63 when the lower holder 110 is in the upper position, as depicted in FIG. 9F. When each of the lower holders 110 is in the upper position, each of the fourth contacting portions 111 may contact the elastic shaft 63 at a position between the end of the elastic shaft 63 and a central portion of the elastic shaft 63 where the first spur roller 56 is disposed. When the lower holder 110 moves from the lower position, as depicted in FIG. 9C, to the upper position, as depicted in FIG. 9D; the lower holder 100 may press to deform the elastic shaft 63, such that the first spur roller 56 may move from the lower position, as depicted in FIG. 9E, to the upper position, as depicted in FIG. 9F. The first spur rollers 56 disposed at the central portion of the upper holder 100 may be retracted to the upper position, such that the recording medium 84 passing under the first spur rollers 56 may not be damaged by the first spur rollers 56.

As depicted in FIG. 7, the rotating member 120 may comprise the fourth rotating shaft 121, e.g., a rotating shaft, extending in the right-left direction 9, the pair of right and left first contacting portions 122, the plurality of second contacting portions 123, and the pair of right and left third contacting portions 124. The first, second, and third contacting portions 122, 123, and 124 may protrude in substantially the same direction from a circumferential surface of the fourth rotating shaft 121. The rotating member 120 may be supported by the upper holder 100, such that the fourth rotating shaft 121 thereof may be fitted into the recessed portion 103 of the upper holder 100 and the rotating member 120 may be disposed in front of the first spur rollers 56, as depicted in FIG. 10A.

The plurality of second contacting portions 123 may be disposed at the central portion of the fourth rotating shaft 121 in the right-left direction 9 and at positions corresponding to the respective lower holders 110. A sliding member 125 may be disposed at a tip end, e.g., a free end, of each first contacting portion 122. The sliding members 125 slidingly may contact with the upper surface 81 of the tray 80. The sliding members 125 may comprise molded resin made of polyoxymethylene ("POM") having a small sliding resistance.

Figure 8A:
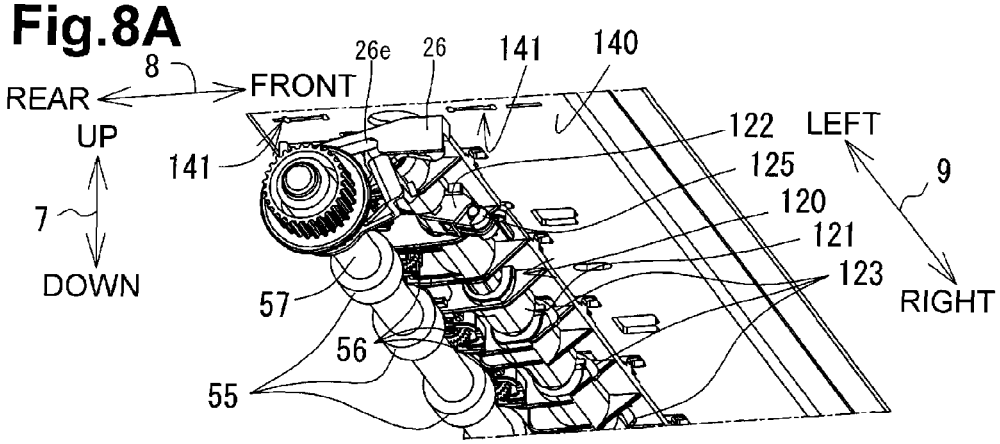
FIG. 8A is a perspective view depicting a moving rotating member at a position, according to an embodiment of the invention.
Figure 8B:
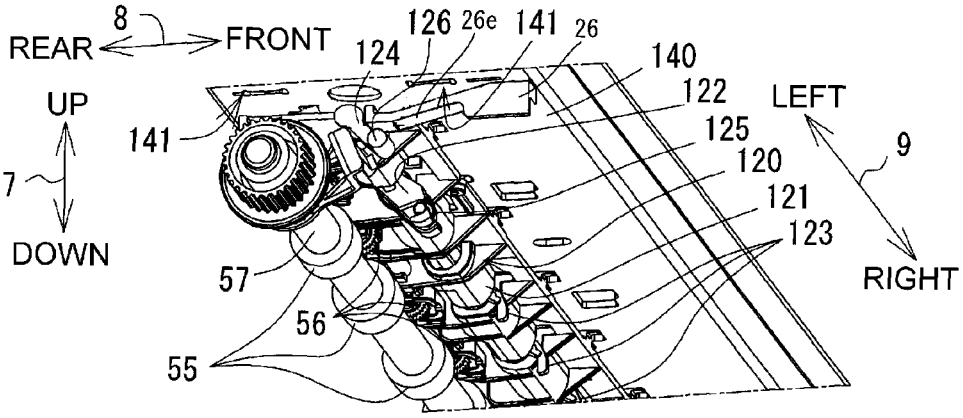
FIG. 8B is a perspective view depicting the moving rotating member of FIG. 8A at another position, according to an embodiment of the invention.
Figure 8C:
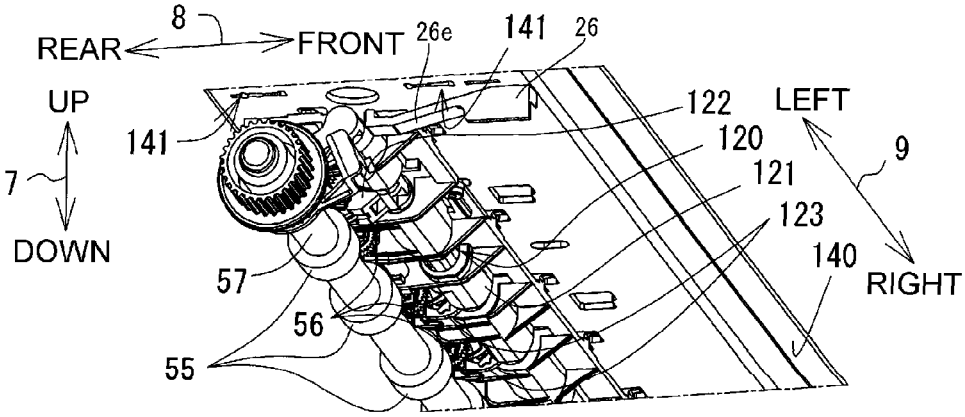
FIG. 8C is another perspective view depicting the moving rotating member of FIGS. 8A and 8B at still another position, according to an embodiment of the invention.

The fourth rotating shaft 121 may be supported by the upper holder 100 and may be configured to rotate between a third position and a second position through a first position. In the third position, the first contacting portions 122 may protrude substantially frontward, as depicted in FIG. 8A. In the first position, the first contacting portions 122 may protrude substantially downward, as depicted in FIG. 8B. In the second position, the first contacting portions 122 may protrude obliquely and substantially rearward and downward, as depicted in FIG. 8C. By the rotation of the fourth rotating shaft 121 in a first rotational direction 150, the fourth rotating shaft 121 may rotate from the third position, as depicted in FIG. 10A, to the second position, as depicted in FIG. 10C, through the first position, as depicted in FIG. 10B. By the rotation of the fourth rotating shaft 121 in a second rotational direction 151, the fourth rotating shaft 121 may rotate from the second position to the third position through the first position.

As depicted in FIG. 10B, the first contacting portions 122 may protrude substantially downward and may protrude into the straight section 35 of the first conveying path 31, when the fourth rotating shaft 121 is in the first position. As depicted in FIG. 9C, the first contacting portions 122 may protrude from the fourth rotating shaft 121 in substantially the same direction as the direction that the second contacting portions 123 protrudes. The first contacting portions 122 may be configured, such that a part of each first contacting portion 122 may protrude further forward at the first position than the second contacting portions 123. The tray 80 inserted from the front may contact the first contacting portions 123 and may press the first contacting portions 123.

The third contacting portions 124 may be disposed at the right and left ends of the fourth rotating shaft 121, respectively. The protrusion 126 may protrude from a free end of each third contacting portion 124. The left protrusion 126 may protrude toward the left, and the right protrusion 126 may protrude toward the right. The protrusions 126 may contact the inclined surfaces 26*e* formed in the right and left link plates 26, as depicted in FIGS. 8A-8C and 12A-12B. The fourth rotating shaft 121 may rotate when the protrusions 126 of the third contacting portion 124 is pressed by the inclined surfaces 26*e* of the link plates 26 moving toward the rear. The inclined surfaces 26*e* of the link plates 26 may be configured such that the fourth rotating shaft 121 may rotate between the first position and the third position. Although the fourth rotating shaft 121 may move between the third position and the second position, the fourth rotating shaft 121 may be rotated by the link plates 26 between the third position, as depicted in FIG. 8A, and the first position, as depicted in FIG. 8B.

As depicted in FIG. 10A, the rotating member 120 may be in the third position when the tray guide 90 is in the upper position. When the tray guide 90 is moved forward by the user to change the position to the lower position, as depicted in FIG. 10B, the link plates 26 may move toward the front in coordination with the forward movement of the tray guide 90. When the link plates 26, as depicted in FIGS. 8B and 12B, move forward, the protrusions 126 of the third contacting portions 124 may be pressed by the inclined surfaces 26*e* of the link plates 26 and the fourth rotating shaft 121 may rotate in the first rotational direction 150. The fourth rotating shaft 121 may rotate from the third position, as depicted in FIGS. 8A and 10A, in which the first contacting portions 122 may protrude frontward, to the first position, as depicted in FIGS. 8B and 10B, in which the first contacting portions 122 may protrude downward.

The tray 80 inserted into the straight section 35 of the first conveying path 31 from the front by the user may contact and press the first contacting portions 122 protruding downward into the straight section 35. By pressing the first contacting portions 122 rearward, by the tray 80 may cause the sliding members 125 to slide over the upper surface 81 of the tray 80, as depicted in FIG. 10C.

When the first contacting portions 122 are pressed rearward by the tray 80, the fourth rotating shaft 121 may rotate in the first rotational direction 150, such that the fourth rotating shaft 121 may move from the first position to the second position. When the fourth rotating shaft 121 moves from the first position to the second position, the second contacting portions 123, which protrudes substantially downward from the fourth rotating shaft 121 in the first position, may rotate in the first rotational direction 150, as depicted in FIG. 9C; and the second contacting portions 123 may push the front end portions of the lower holders 110 upward, as depicted in FIG. 9D. The lower holders 110 may rotate in a third rotational direction 152 when their front end portions are pushed up by the corresponding second contacting portions 123. When the lower holders 110 rotate in the third rotational direction 152, the fourth contacting portions 111 separated from the elastic shaft 63, as depicted in FIG. 9E, may push upward and deform the respective elastic shafts 63, as depicted in FIG. 9F. When the elastic shafts 63 are deformed, the first spur rollers 56 supported by the respective elastic shafts 63 may move from the lower position, as depicted in FIG. 9E, to the upper position, as depicted in FIG. 9F. When the tray 80 is inserted, the first spur rollers 56 may be retracted upward, as depicted in FIG. 10C.

The second contacting portions 123 protruding substantially rearward from the fourth rotating shaft 121 in the second position may be urged downward by the elastic shafts 63 when the second contacting portions 123 deforms the elastic shafts 63 via the lower holders 110. When the free end portions of the second contacting portions 123 are urged downward, the fourth rotating shaft 121 may be urged in the second rotational direction 151, such that the first contacting portions 122 may be pressed against the upper surface 81 of the tray 80. The tray 80 may be pressed against the second drive rollers 55 by the first contacting portions 122. The tray 80 may be conveyed while pinched between the first contacting portions 122 and the second drive rollers 55.

When the tray 80 is removed from the straight section 35 of the first conveying path 31 after an image has been recorded onto the recording medium 84, the rotating member 120, which no longer supports the tray 80, may be rotated in the second rotational direction 151, as depicted in FIG. 10B, by the urging force from the elastic shafts 63 and may return from the second position to the first position. When the link plates 26 are moved rearward by the pushing of the tray guide 90 to change to the upper position from the lower position, the third contacting portions 124 may be moved rearward by the link plates 26, and the fourth rotating shaft 121 may return from the first position to the third position, as depicted in FIG. 10A.

Figure 11:
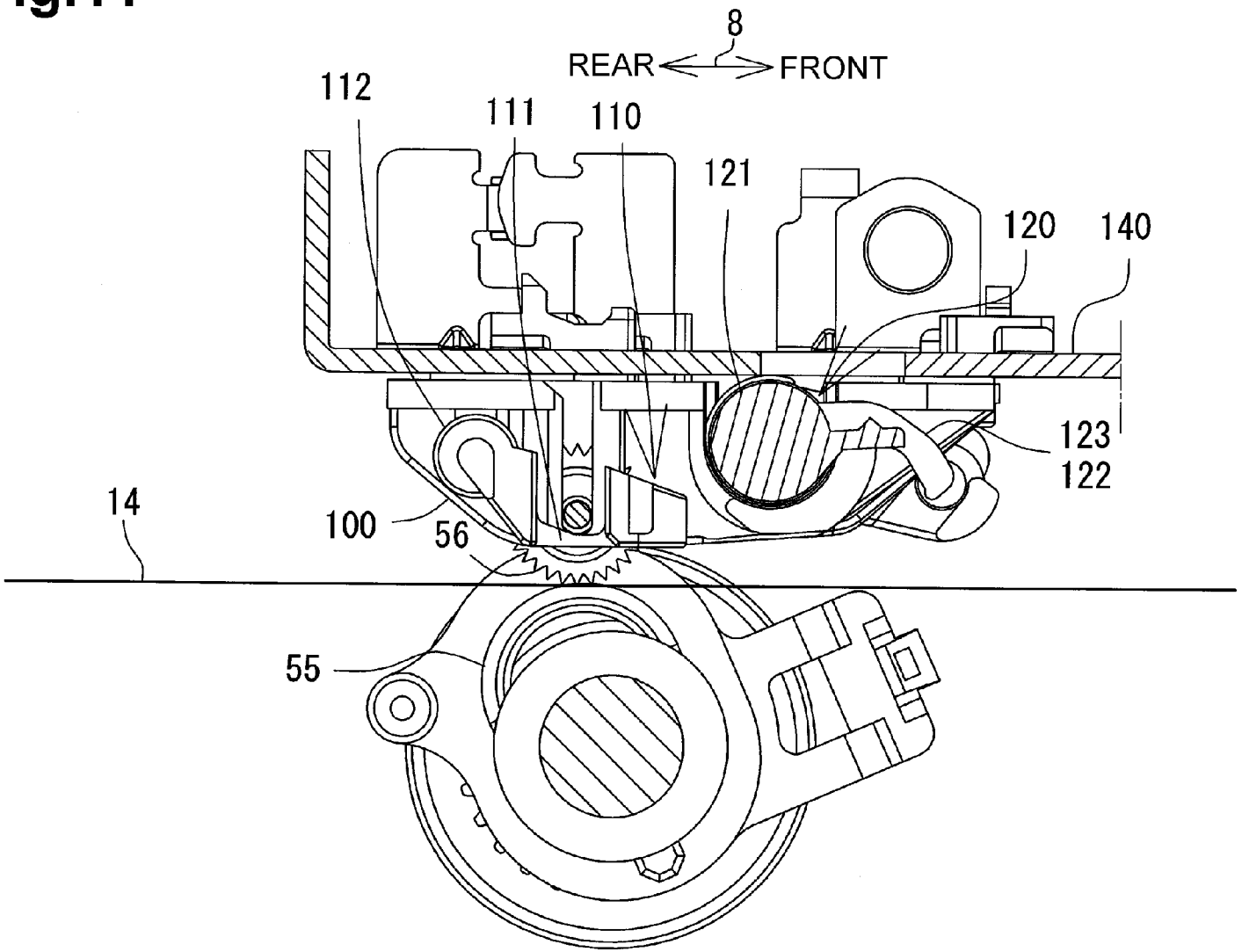
FIG. 11 is a diagram depicting the conveyance of the sheet by the second conveyor roller portion, according to an embodiment of the invention.

For image recording on a sheet 14, a sheet 14 may be fed into the first conveying path 31 from the sheet cassette 15 by the feeding rollers 23. The fed sheet 14 may be conveyed in the first conveying direction 36 by the first and second conveyor roller portions 50 and 54. A single line of printing may be performed on the sheet 14 on the platen 38 by the recording portion 40. The sheet 14 then may be conveyed to start next single line of printing in a new line, e.g., a line feed process. An image may be recorded on the sheet 14 by alternately performing a single line of printing and a line feed. The sensing mechanism may be configured to detect the conveyed distance of the sheet 14. The sheet 14, on which the image has been recorded, may be conveyed by the first conveyor roller portion 50, the second conveyor roller portion 54, and the third conveyor roller portion 58. For single-sided printing, the sheet 14 then may be discharged onto the discharged sheet rest 18. For double-sided printing, the sheet 14, on which the image has been recorded on one side thereof, may be conveyed into the second conveying path 32 by the third conveyor roller portion 58 and may enter the first conveying path 31 at the first junction 45. The sheet 14 then may be turned upside down and conveyed in the first conveying path 31 in the first conveying direction 36. An image then may be recorded onto the other side of the sheet 14, and the sheet 14 may be discharged onto the discharged sheet rest 18 by the third conveyor roller portion 58. As depicted in FIG. 11, during the conveyance of the sheet 14, the fourth rotating shaft 121 may be in the third position, and the first contacting portions 122 and the second contacting portions 123 may protrude substantially frontward from the fourth rotating shaft 121 and may not contact the sheet 14 discharged by the third conveyor roller portion 58.

For image recording onto a recording medium 84, the tray guide 90 at the upper position, as depicted in FIG. 10A, may be moved forward to the lower position, as depicted in FIG. 10B. When the tray guide 90 is moved forward, the link plates 26 may move forward. By the forward movement of the link plates 26, the platen 38, the second drive rollers 55 and the third drive roller 59 at their respective positions, as depicted in FIG. 10A, may descend to the positions, as depicted in FIG. 10B. Thus, the straight section 35 of the first conveying path 31 may be expanded. The third contacting portions 124 of the rotating member 120 may be pressed toward the front by the link plates 26 moving frontward, and the fourth rotating shaft 121 may rotate in the first rotational direction 150. The link plates 26 may move the printing portion 11 from a first state, in which the second drive rollers 55 are in the upper position and the rotating member 120 is in the third position, to a second state, in which the second drive rollers 55 are in the lower position and the rotating member 120 is in the first position.

The fourth rotating shaft 121 may move from the third position to the first position by rotating in the first rotational direction 150. The first contacting portions 122 may protrude downward from the fourth rotating shaft 121, which is in the first position, and may be on the straight section 35 of the first conveying path 31. The tray 80 inserted toward the rear from the opening 19 may be guided by the tray guide 90 and may pass between the third drive roller 59 and the second spur roller 60. The tray 80 then may contact and press the first contacting portions 122 protruding to the straight section 35. The first contacting portions 122 pressed rearward by the tray 80 may slide over the upper surface 81 of the tray 80, as depicted in FIG. 10C. The pressing of the first contacting portions 122 by the tray 80 may cause the fourth rotating shaft 121 to rotate in the first rotational direction 150 and to move from the first position to the second position. The second contacting portions 123 may move from the first position in which the second contacting portions 123 protrude substantially downward from the fourth rotating shaft 121, as depicted in FIG. 9C, to the second positions in which the second contacting portions 123 protrude substantially rearward from the fourth rotating shaft 121, as depicted in FIG. 9D. The second contacting portions 123 may push the front end portions of the respective lower holders 110 upward to rotate the lower holders 110 about their rotating shafts 112 in the third rotational direction 152. The lower holders 110 may move from the lower position, in which the fourth contacting portions 111 are separated from the elastic shafts 63, as depicted in FIG. 9E, to the upper position, as depicted in FIG. 9F, and may push upward and deform the elastic shafts 63 by the fourth contacting portions 111. The first spur rollers 56 supported by the elastic shafts 63 may retract upward by the deformation of the elastic shafts 63.

As depicted in FIG. 10C, the tray 80 inserted into the straight section 35 of the first conveying path 31 may be conveyed while pinched between the first contacting portions 122 of the rotating member 120 and the second drive rollers 55, without contacting the first spur rollers 56, which may be retracted upward.

The tray 80 conveyed rearward by the second drive rollers 55 then may reach the first conveyor roller portion 50 and may be further conveyed by the first drive roller 51 and the second drive rollers 55. The tray 80 holding the recording medium 84 may pass under the recording portion 40 and then may be conveyed toward the front. While the tray 80 may be conveyed toward the front, an image may be recorded on the recording medium 84 by the recording portion 40 that ejects ink droplets. After the image is recorded on the recording medium 84, the tray 80 may be conveyed toward the front by the second drive rollers 55 and placed back onto the tray guide 90, as depicted in FIG. 10C. The tray 80 placed back onto the tray guide 90 may be removed later from the printer portion 11.

The first spur rollers 56 may retract upward and the tray 80 may press against the second drive rollers 55 by the first contacting portions 122, such that the second drive rollers 55 may convey both the sheet 14 and the tray 80. The first contacting portions 122 of the rotating member 120 may protrude toward the straight section 35 of the first conveying path 31 when the tray guide 90 is drawn toward the front. When the sheet 14 is conveyed while the tray guide 90 is in the upper position before the tray guide 90 is drawn, the first contacting portions 122 may be separated from the straight section 35, such that the first contacting portions 122 may not contact the sheet 14 being conveyed in the straight section 35. Because the tray guide 90 may rotate the fourth rotating shaft 121 from the third position to the first position, the fourth rotating shaft 121 may be rotated without opposing the urging force of the elastic shafts 63. Thus, less force is required to draw the tray guide 90 toward the front. Therefore, the sheet 14 may be conveyed without hindrance and the inkjet recording apparatus 10 having greater utility may be implemented. The second contacting portions 123 may protrude in substantially the same direction as the first contacting portions 122, such that the second contacting portions 123 may not contact the sheet 14 being conveyed.

When the tray guide 90 is drawn to allow the tray 80 to be inserted, the fourth rotating shaft 121 may move to the first position and the second drive rollers 55 and the third drive roller 59 may move downward. Therefore, the tray 80 may be prevented from being inserted, without moving the first spur rollers 56, the first drive rollers 55, and the third drive roller 59 downward. Accordingly, the tray 80, which is inserted into the straight section 35, may be prevented from colliding against the first spur rollers 56, the first drive rollers 55, and the third drive roller 59.

The third contacting portions 124 pressed by the link plates 26 may be disposed on the both ends of the fourth rotating shaft 121. Thus, the fourth rotating shaft 124 may be rotated with the force received at the both end portions thereof, and the fourth rotating shaft 124 may not be twisted by the force. The fourth rotating shaft 121 may comprise a material having high stiffness. Accordingly, a single third contacting portion 124 may be disposed at either of the ends of the fourth rotating shaft 121.

Figure 13A:
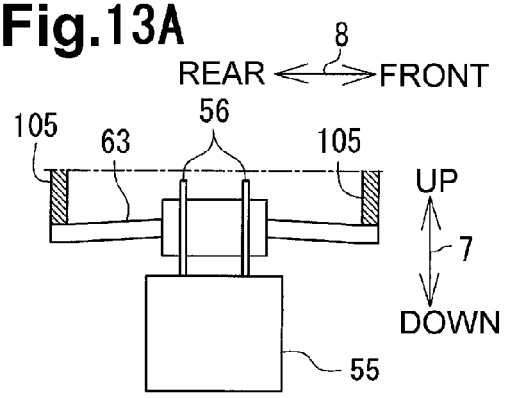
FIG. 13A is a diagram depicting the deformation of an elastic shaft, according to another embodiment of the invention.
Figure 13B:
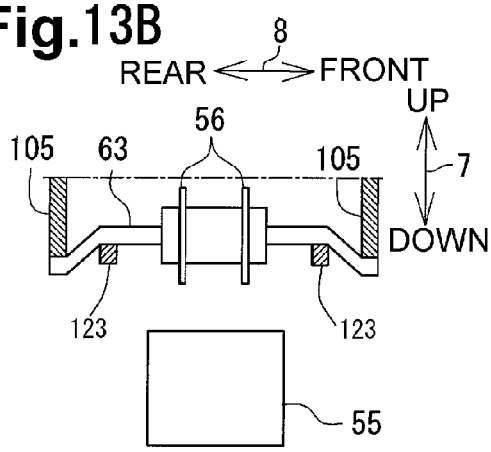
FIG. 13B is another diagram depicting the deformation of the elastic shaft in FIG. 13A, according to another embodiment of the invention
Figure 13C:
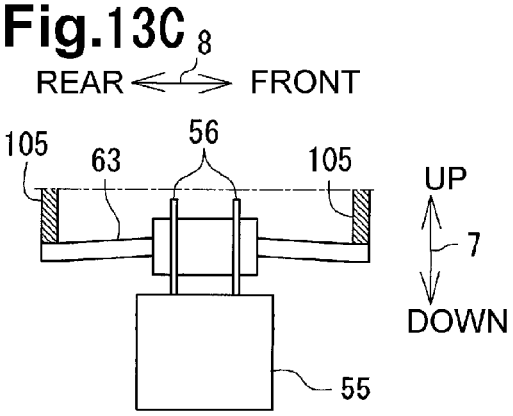
FIG. 13C is still another diagram depicting the deformation of the elastic shaft in FIG. 13A, according to still another embodiment of the invention
Figure 13D:
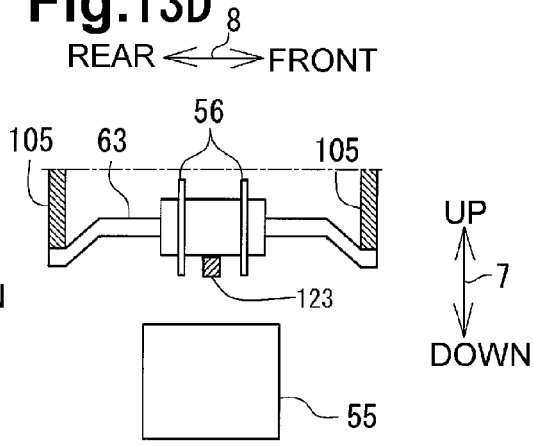
FIG. 13D is yet another diagram depicting the deformation of the elastic shaft in FIG. 13A, according to still another embodiment of the invention.

The elastic shafts 63 may be deformed by the second contacting portions 123 via the lower holders 110. In another embodiment, as depicted in FIG. 13B, the elastic shafts 63 may be pressed directly by the second contacting portions 123 to deform. In still another embodiment, as depicted in FIG. 13D, the first spur rollers 56 may be pressed directly by the second contacting portions 123 to deform the elastic shafts 63.

The sliding members 125 disposed at the free ends of the first contacting portions 122 of the rotating member 120 may contact the upper surface 81 of the tray 80. In another embodiment, second following rollers, e.g., a roller, may be provided instead of the sliding members 125. The second following rollers may reduce resistance due to the conveyance of the tray 80, such that a difference between a rotating amount of the first drive roller 51 detected by the sensing mechanism and an actual moving amount of the tray 80 may be reduced and the accuracy in the image recording may be improved.

The inkjet recording apparatus 10 may comprise the second conveying path 32 and the third conveyor roller portion 58 and may be configured to perform the double-sided printing. In another embodiment, the inkjet recording apparatus 10 be configured to perform single-sided printing and may not comprise the second conveying path 32 and the third conveyor roller portion 58.

When, after having been drawn frontward, the tray guide 91 is pushed rearward, and the link plates 26 are moved rearward, the fourth rotating shaft 121 may rotate from the first position to the third position in coordination with the movement of the link plates 26. In another embodiment, a torsion coil spring, e.g., a second urging member, configured to urge the fourth rotating shaft 121 in the first position toward the third position may be provided to the rotating member 120, instead of the configuration in which the fourth rotating shaft 121 is returned to the third position by the link plates 26. When the link plates 26 are moved rearward, the fourth rotating shaft 121 may be rotated by the torsion coil spring and may return to the third position, such that a force required for pushing the tray guide 90 back to the upper position may be reduced. As a result, the utility of the inkjet recording apparatus 10 may be increased.

The fourth rotating shaft 121 may be rotated from the third position to the first position by the tray guide 90 and the link plates 26. In another embodiment, the fourth rotating shaft 121 may be rotated by a drive motor, which may be rotatable in both forward and reverse directions and whose rotational amount may be controlled. The drive motor may be provided separately from other motors for driving the feeding rollers 23, the first drive roller 51, the second drive rollers 55, and the carriage 41. This drive motor may be used for the other motors. For example, the feeding rollers 23 may be rotated by rotation of a first drive motor in one of the rotating directions, and the fourth rotating shaft 121 may be rotated from the third position toward the first position by rotation of the first drive motor in another of the rotating directions, by using a planet gear mechanism. For example, the fourth rotating shaft 121 in the first position may be rotated back to the third position by a torsion coil spring, e.g., a further urging member. The fourth rotating shaft 121 may be rotated by which power of a second drive motor for rotating the first drive roller 51 and the second drive roller 55 or power of a third drive motor for moving the carriage 41 may be transmitted by using a gear switching mechanism. In the above-described embodiment, a motor having lower torque may be used as the drive motor for rotating the fourth rotating shaft 121. Accordingly, usage restrictions on the torque of the drive motor may be relieved, or the fourth rotating shaft 121 may be rotated by using the existing motors, for example, the first, second, or third motors. The drive motor for rotating the fourth rotating shaft 121 may correspond to a drive motor of the invention.

The amount of deformation of the elastic shafts 63 when the first spur rollers 56 are in the upper position may be greater than that when the first spur rollers 56 are in the lower position. The force of the second drive rollers 55 and the rotating member 120 pinching the tray 80 may be greater than the force of the second drive rollers 55 and the first spur rollers 56 pinching the sheet 14. In another embodiment, the amount of deformation of the elastic shafts 63 when the first spur rollers 56 are in the upper position may be less than that when the first spur rollers 56 are in the lower position if the tray 80 is conveyed while pinched between the second drive rollers 55 the first spur rollers 56.

While the invention has been described in connection with various exemplary structures and illustrative embodiments, it will be understood by those skilled in the art that other variations and modifications of the structures, configurations, and embodiments described above may be made without departing from the scope of the invention. For example, this application comprises any possible combination of the various elements and features disclosed herein, and the particular elements and features presented in the claims and disclosed above may be combined with each other in other ways within the scope of the application, such that the application should be recognized as also directed to other embodiments comprising any other possible combinations. Other structures, configurations, and embodiments will be apparent to those skilled in the art from a consideration of the specification or practice of the invention disclosed herein. It is intended that the specification and the described examples are illustrative with the true scope of the invention being defined by the following claims.

What is claimed is:

1. A conveyor device comprising:

a drive roller configured to selectively convey one of a tray and a sheet through a conveying path;

a rotating shaft extending in a direction parallel to an axial direction of the drive roller and configured to selectively rotate between a third position and a second position via a first position;

a spur roller disposed opposite from the drive roller across the conveying path and configured to move between a fourth position, in which the spur roller contacts the drive roller, and a fifth position, in which the spur roller separates from the drive roller at a distance greater than a thickness of the tray;

a first contacting portion protruding from the rotating shaft in a radial direction of the rotating shaft, wherein the first contacting portion is disposed in the conveying path when the rotating shaft is in the first position, the first contacting portion is configured to contact one surface of the tray passing through the conveying path when the rotating shaft is in the second position, and the first contacting portion is separated from the conveying path when the rotating shaft is in the third position;

a second contacting portion protruding from the rotating shaft in the radial direction and configured to move the spur roller, such that, when the rotating shaft is in the first position, the spur roller is in the fourth position, and when the rotating shaft is in the second position, the spur roller is in the fifth position; and a rotating unit configured to rotate the rotating shaft from the third position to the first position.

2. The conveyor device according to claim 1, wherein the first contacting portion comprises a sliding member disposed at a distal end of the first contacting portion and configured to slide on the one surface of the tray passing through the conveying path when the rotating shaft is in the second position, wherein the sliding member has a sliding resistance less than that of the first contacting portion.

3. The conveyor device according to claim 1 wherein the first contacting portion comprises a roller disposed at a distal end of the first contacting portion and configured to rotate on the one surface of the tray passing through the conveying path when the rotating shaft is in the second position.

4. The conveyor device according to claim 1, further comprising:

a third contacting portion protruding from the rotating shaft in the radial direction, wherein the rotating unit comprises a movable member configured to engage the third contacting portion and move between a forward position and a rearward position, and wherein the movable member is configured to rotate the rotating shaft, such that, when the movable member is in the forward position, the rotating shaft is in the first position, and when the movable member is in the rearward position, the rotating shaft is in the third position.

5. The conveyor device according to claim 4, further comprising:

a tray guide configured to move between a guiding position, in which the tray guide is configured to feed the tray into the conveying path, and a retracted position, in which the tray guide is retracted from the conveying path, wherein the tray guide is configured to move the movable member, such that, when the movable member is in the rearward position, the tray guide is in the retracted position, and when the movable member is in the forward position, the tray guide is in the guiding position.

6. The conveyor device according to claim 4, wherein the drive roller is configured to move between a sheet-conveying position, in which the drive roller and the spur roller are configured to nip and convey the sheet, and a tray-conveying position, in which the drive roller is configured to convey the tray, wherein the movable member is configured to move the drive roller, such that, when the movable member is in the rearward position, the drive roller is in the sheet-conveying position, and when the movable member is in the forward position, the drive roller is in the tray-conveying position.

7. The conveyor device according to claim 1, wherein the rotating unit comprises a drive motor configured to rotate the rotating shaft from the third position to the first position.

8. The conveyor device according to claim 1, further comprising a particular urging member configured to urge the spur roller toward the drive roller.

9. The conveyor device according to claim 8, wherein the second contacting portion is configured to move the spur roller from the fourth position to the fifth position while opposing an urging force of the particular urging member when the rotating shaft rotates from the first position to the second position.

10. The conveyor device according to claim 1, further comprising a further urging member configured to urge the rotating shaft from the first position to the third position.

11. The conveyor device according to claim 1, wherein the drive roller is configured to convey a recording medium disposed in the tray.

12. An inkjet recording apparatus, comprising:

a conveyor device comprising:

a drive roller configured to selectively convey one of a tray and a sheet through a conveying path;

a rotating shaft extending in a direction parallel to an axial direction of the drive roller and configured to selectively rotate between a third position and a second position via a first position;

a spur roller disposed opposite from the drive roller across the conveying path and configured to move between a fourth position, in which the spur roller contacts the drive roller, and a fifth position, in which the spur roller separates from the drive roller at a distance greater than a thickness of the tray;

a first contacting portion protruding from the rotating shaft in a radial direction of the rotating shaft, wherein the first contacting portion is disposed in the conveying path when the rotating shaft is in the first position, the first contacting portion is configured to contact one surface of the tray passing through the conveying path when the rotating shaft is in the second position, and the first contacting portion is separated from the conveying path when the rotating shaft is in the third position;

a second contacting portion protruding from the rotating shaft in the radial direction and configured to move the spur roller, such that, when the rotating shaft is in the first position, the spur roller is in the fourth position, and when the rotating shaft is in the second position, the spur roller is in the fifth position; and a rotating unit configured to rotate the rotating shaft from the third position to the first position; and a recording portion configured to record an image on the sheet or a recording medium disposed in the tray passing through the conveying path by ejecting ink droplets on the sheet or the recording medium.

* * * * *